US008336466B2

(12) United States Patent
Mani

(10) Patent No.: US 8,336,466 B2
(45) Date of Patent: Dec. 25, 2012

(54) PALLETS

(76) Inventor: Ayyakannu Mani, Rochester Hills, MI (US)

( * ) Notice: Subject to any disclaimer, the term of this patent is extended or adjusted under 35 U.S.C. 154(b) by 1314 days.

(21) Appl. No.: 10/575,637

(22) PCT Filed: Oct. 14, 2004

(86) PCT No.: PCT/US2004/034233

§ 371 (c)(1),
(2), (4) Date: Apr. 29, 2010

(87) PCT Pub. No.: WO2005/037687

PCT Pub. Date: Apr. 28, 2005

(65) Prior Publication Data

US 2010/0218705 A1 Sep. 2, 2010

Related U.S. Application Data

(60) Provisional application No. 60/511,012, filed on Oct. 14, 2003, provisional application No. 60/545,106, filed on Feb. 17, 2004, provisional application No. 60/592,994, filed on Jul. 30, 2004.

(51) Int. Cl.
*B65D 19/38* (2006.01)

(52) U.S. Cl. ..... 108/57.17; 108/57.12; 108/57.32

(58) Field of Classification Search ..... 108/57.12, 108/53.1, 57.32, 56.1, 56.3, 57.1, 57.17–57.19
See application file for complete search history.

(56) References Cited

U.S. PATENT DOCUMENTS

| | | | | |
|---|---|---|---|---|
| 5,367,960 | A * | 11/1994 | Schleicher | 108/57.32 |
| 5,829,364 | A * | 11/1998 | Urbach | 108/56.1 |
| 6,352,039 | B1 * | 3/2002 | Woods et al. | 108/57.25 |
| 6,622,642 | B2 * | 9/2003 | Ohanesian | 108/57.25 |
| 6,694,894 | B1 * | 2/2004 | Darnell | 108/53.1 |
| 6,892,651 | B1 * | 5/2005 | Van Reed et al. | 108/56.1 |
| 8,127,691 | B2 * | 3/2012 | Ingham | 108/57.25 |

* cited by examiner

*Primary Examiner* — Hanh V Tran
(74) *Attorney, Agent, or Firm* — Dickinson Wright, PLLC

(57) ABSTRACT

Enhanced pallets including a plurality of hollow blocks and a plurality of hollow cross members are provided. The pallets may be aluminum extruded pallets. The blocks and cross members are welded together to form a pallet. The blocks and cross members may have internal wall structures which, form one or more crush cells or crush zones. The crush cells or crush zones deform in a controlled manner on impact to reduce impact damage to the pallets. The pallets have a high load strength supporting capability and allow the pallets to withstand repeated or severe impacts while remaining functional.

13 Claims, 23 Drawing Sheets

PALLETS

CROSS REFERENCE TO RELATED APPLICATIONS

This application claims priority of provisional patent application No. 60/592,994 filed on Jul. 30, 2004, provisional patent application No. 60/545,106 filed on Feb. 17, 2004, and provisional patent application No. 60/511,012 filed on Oct. 14, 2003 which are incorporated herein by reference in their entirety.

BACKGROUND OF THE INVENTION

The present invention generally pertains to pallets. More specifically, the present invention pertains to metallic pallets, particularly aluminum pallets. The present invention also pertains to methods of making pallets.

Pallets are commonly used to support and transport objects or loads. Existing pallets have been constructed from wood. Wood pallets are typically constructed from various wood boards assembled together by fasteners, such as nails or staples. Wood pallets can have disadvantages. For example, wood pallets may be water or fluid absorbent, environmentally unfriendly, susceptible to damage, susceptible to tire, and rather heavy.

Pallets have also been constructed from plastic materials. Existing plastic material pallets also can have disadvantages. Plastic material pallets may not be fire retardant. Fire retardants, such as bromine, can be added to plastic material pallets.

However, such additives tend to significantly increase the costs of plastic pallets and may not be desired for food carrying applications.

Pallets are generally subjected to significant abuse and pallet damage can be a concern. Pallets may be struck by fork lift tines or dropped on an edge of the pallet, for example. The impact of a fork lift tine on a pallet can cause significant damage to the pallet and compromise the pallet's functional ability and even render the pallet unusable. Similarly, pallets may be dropped on a side, edge or corner and suffer damage.

Accordingly, needs exist to improve pallets for the reasons mentioned above and for other reasons.

SUMMARY OF THE INVENTION

The present invention provides improved pallets. One improved pallet according to the present invention is an extruded aluminum pallet. The extruded aluminum pallet has a plurality of hollow extruded aluminum components welded together to form a pallet. A plurality of hollow extruded aluminum blocks and a plurality hollow extruded aluminum cross members are welded together to form the aluminum pallet. The blocks and the cross members are orientated perpendicular to each other. Various internal ribs or walls are provided inside of the hollow blocks and the hollow cross members. Components of the pallet, particularly corner blocks, may have one or more crush zones which deform on impact to reduce damage caused to the pallet.

The extruded aluminum pallet according to the present invention provides remarkable strength. Also, the pallet resists damage, which can be caused by impact to the pallet or dropping the pallet, for example. The pallet is light weight, yet provides sufficient strength to support heavy loads. For example, one extruded aluminum pallet according to the present invention can support a 15,000 lbs load. The aluminum pallet is fire retardant and environmentally friendly. The aluminum pallet can be recycled if desired.

One or more embodiments of the present invention are described as being constructed of extruded aluminum. However, the present invention is not necessarily limited to pallets constructed of extruded aluminum. Pallets according to the present invention can be constructed from aluminum components which are not extruded. For example, rolled aluminum or other aluminum components may be used with the present invention. Furthermore, materials other than aluminum may be used to construct pallets according to the present invention. For example, other metal materials and non-metal materials may be used in pallets of the present invention. Also, combinations of any of the materials may be suitably used to make pallets according to the present invention.

One an advantage of the present invention is to provide an improved pallet.

Another advantage of the present invention is to provide an improved aluminum pallet.

A further advantage of the present invention is to provide a light-weight, high strength pallet.

Yet another advantage of the present invention is to provide a pallet which resists impact damage.

An advantage of the present invention is to provide an extruded aluminum pallet which has sufficient strength, stiffness, and impact resistance for pallet applications.

Another advantage is to provide an improved method of making pallets.

Additional features and advantages of the present invention are described in, and will be apparent from, the following Detailed Description of the Invention and the figures. The features and advantages may be desired, but, are not necessarily required to practice the present invention.

DETAILED DESCRIPTION OF THE INVENTION

Figure 1:
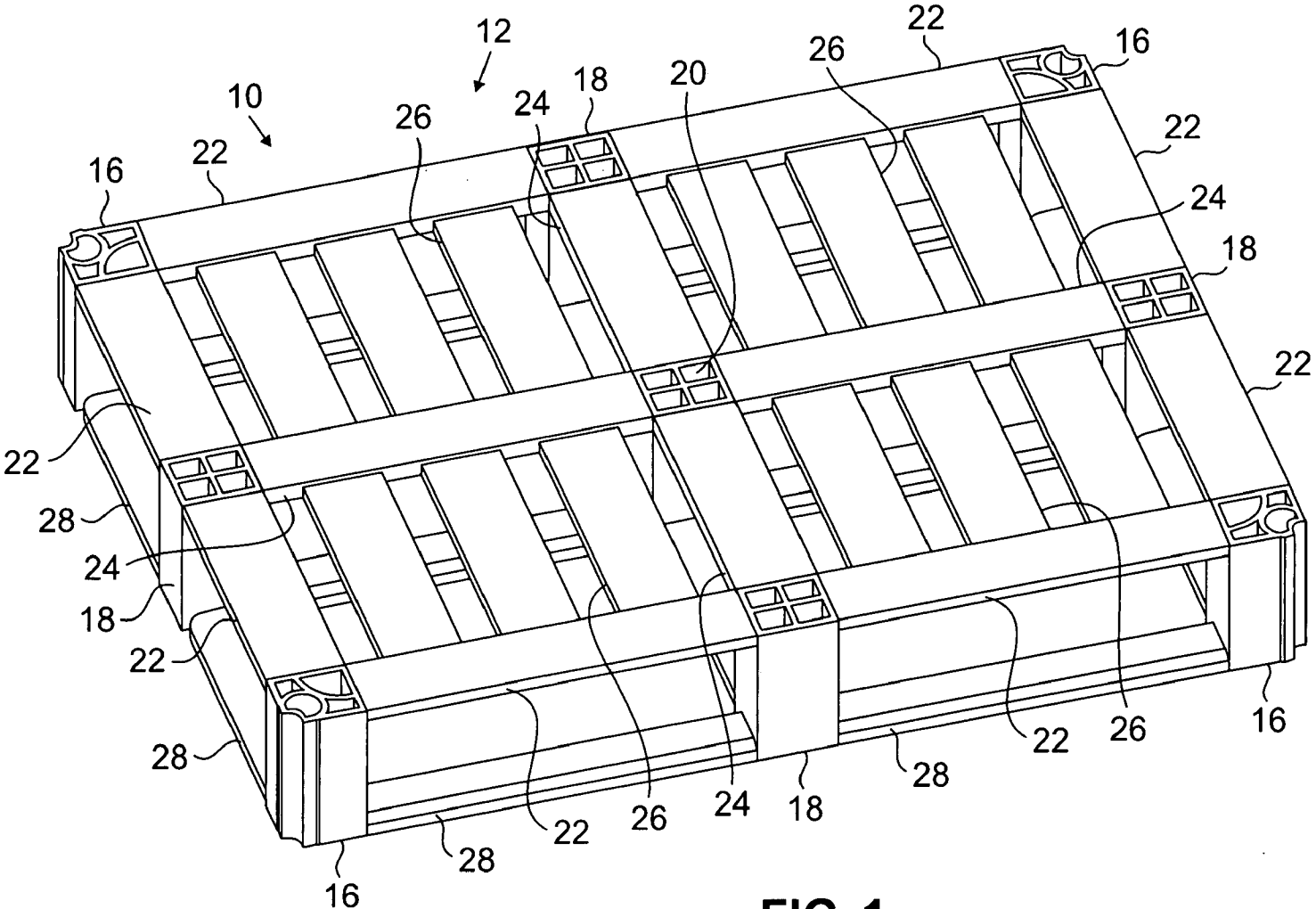
FIG. 1 shows a top perspective view of an aluminum pallet according to the present invention.
Figure 2:
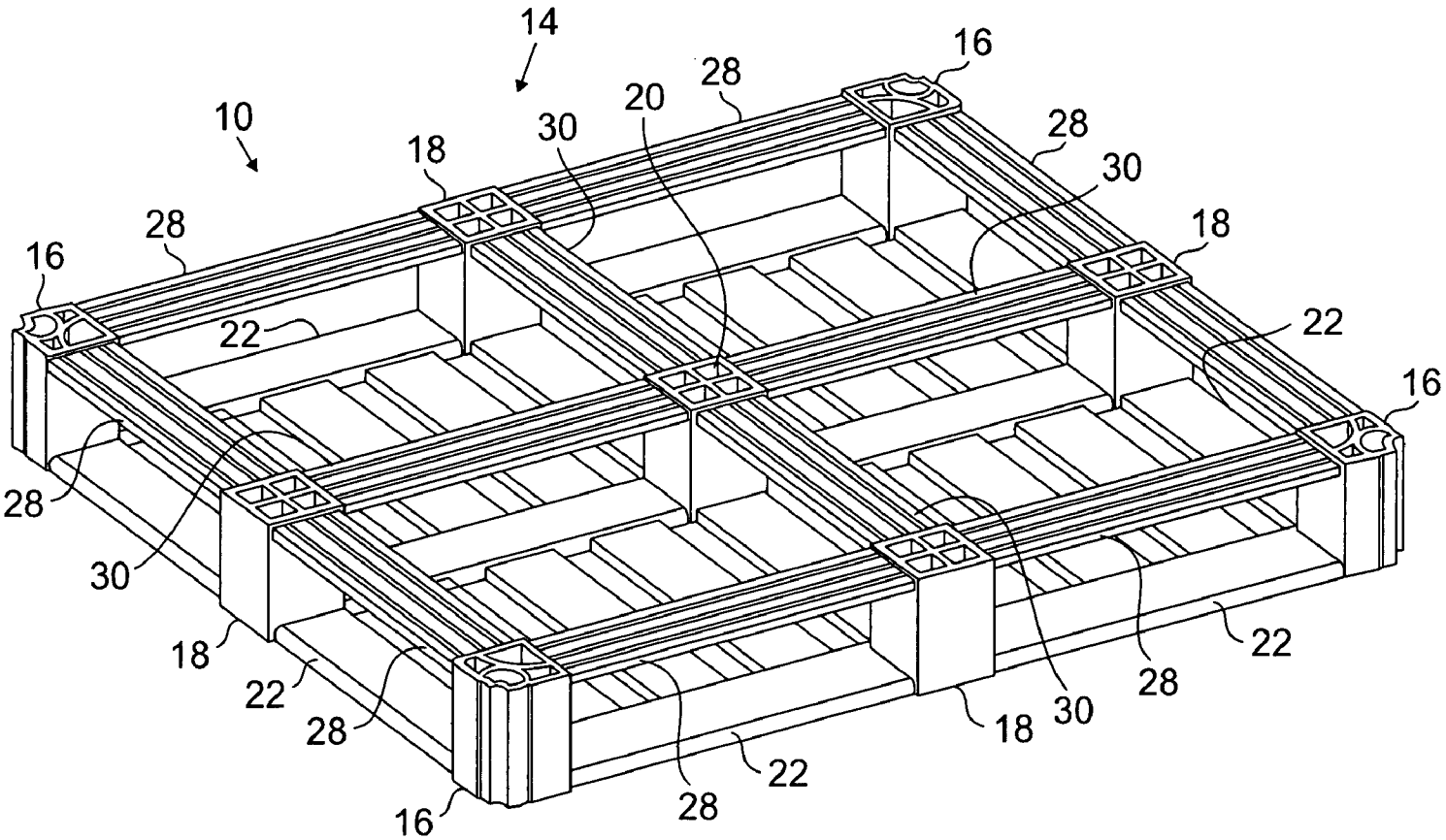
FIG. 2 shows a bottom perspective view of the aluminum pallet of FIG. 1.

One example of a pallet according to the present invention is shown in FIGS. 1 and 2. The pallet 10 of FIGS. 1 and 2 is an extruded aluminum pallet. FIG. 1 shows a top side 12 of the extruded aluminum pallet 10 and FIG. 2 shows a bottom side 14 of the aluminum pallet 10. The aluminum pallet 10 has a plurality of extruded aluminum blocks 16, 18, 20 and extruded aluminum cross members 22, 24, 26, 28, 30 welded together. The blocks 16, 18, 20 are oriented with a generally vertical axis and the cross members 22, 24, 26, 28, 30 are orientated with a generally horizontal axis. The blocks 16, 18, 20 and the cross members 22, 24, 26, 28, 30 are positioned relative to each other such that their respective faces are generally perpendicular. Also, in this embodiment the ends of the cross members are welded to the faces of the blocks 16, 18, 20 rather than the cross members overlapping the top or bottom sides of the blocks 16, 18, 20.

The blocks 16, 18, 20 and the cross members 22, 24, 26, 28, 30 are hollow tubes and may be made out of any suitable hollow tubular components in addition to extruded aluminum. For example, hydroformed hollow tubes may be suitable hollow tubular shapes according to the present invention.

Figure 3:
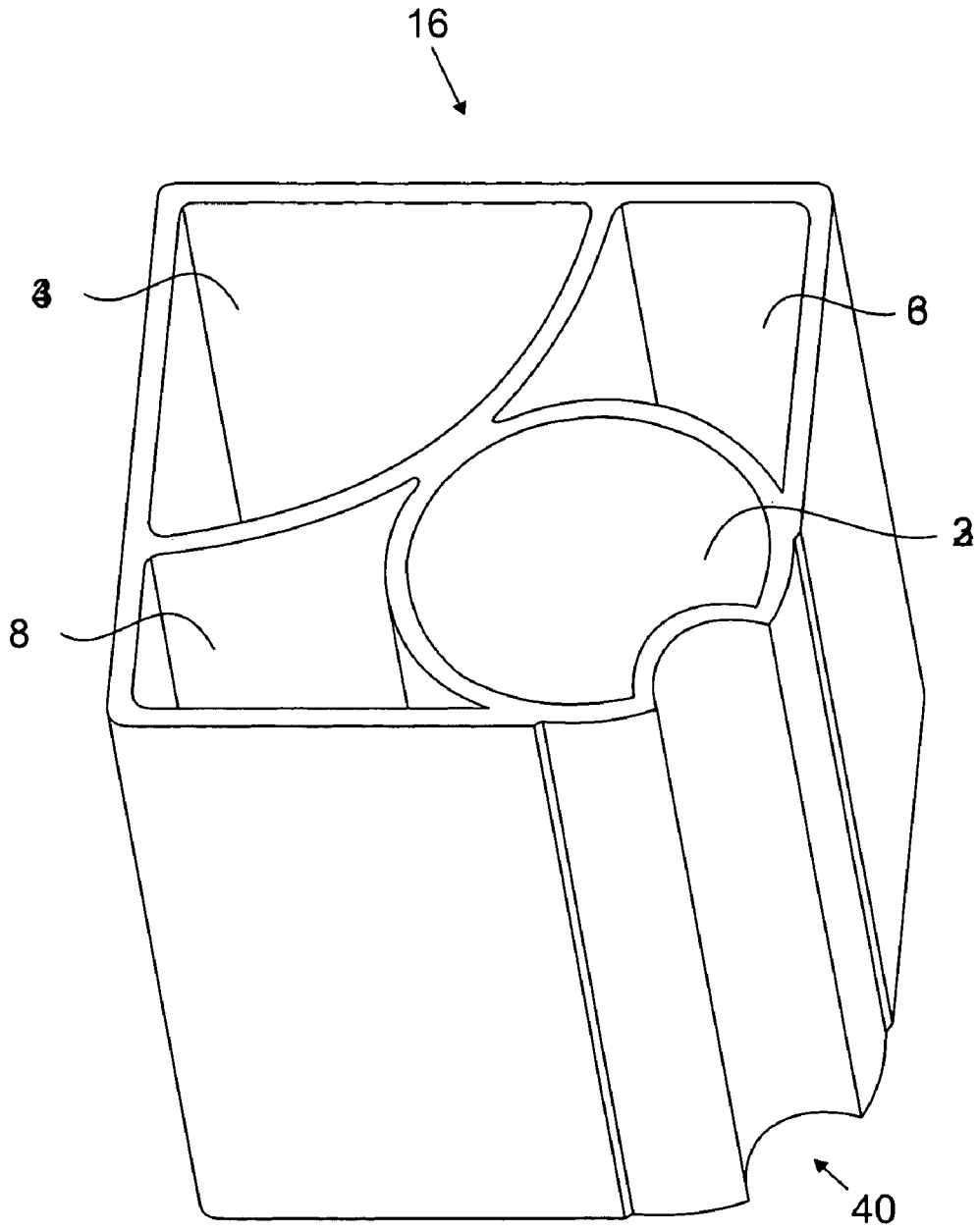
FIG. 3 shows a perspective view of a corner block of the aluminum pallet of FIG. 1.

A corner block 16 of the aluminum pallet is shown in FIG. 3. The corner block 16 is provided at the four corners of the aluminum pallet 10. The corner block 16 is a hollow aluminum extrusion having an internal rib or wall structure which forms a plurality of internal cells 32, 34, 36, 38. The internal wall structure provides the corner block 16 with strength, stiffness and resistance to denting.

At least one of the internal cells 32, 34, 36, 38 of the corner blocks forms a crush cell or crush zone. In this embodiment, cells 32 and 34 are crush cells. The crush cells 32, 34 deform and absorb energy on impact in a manner that reduces impact damage to the pallet 10. The corner block 16 can provide for a controlled deformation of the corner block 16 due to impact or dropping of the pallet 10, for example. The corner 40 of the corner block 16 tends to deform inward into the corner internal crush cell 32 when the pallet 10 is dropped at an angle on the corner block 16 or otherwise impacted at the corner block 16. The controlled deformation can allow the pallet 10 to still be used for its intended purpose even though the pallet 10 sustained damage. Otherwise, if the corner 40 tended to deform outwardly, the damage to the pallet 10 may render the pallet 10 non-useable. Outward deformation or bulging of a damaged pallet 10 can interfere with the tines of a forklift or may interfere with stacking of pallets, for example. The corner block 16 has an inwardly curved corner 40; however, the corner 40 can have other configurations as well.

The corner block 16 can be designed to crush in a controlled manner in 10 ft corner drop tests without fracturing the corner block 16. Also, due to the cushioning effect of the corner block 16, loads applied to other components of the pallet 10 and/or the welded joints are reduced or even eliminated.

Corner blocks according to the invention can have multi-stage crush cells or crush zones. A corner block according to the present invention having multi-stage crush cells can withstand three impacts from 10 ft high without facture. The corner blocks have structural geometry designed in such a way to avoid stretching in any portion of the corner block because stretching induces tensile fracture. Instead, portions of the corner block are designed to absorb energy in predominantly a free bending mode.

A further description of the corner block and the crush cells or zones is provided below.

Figure 4A:
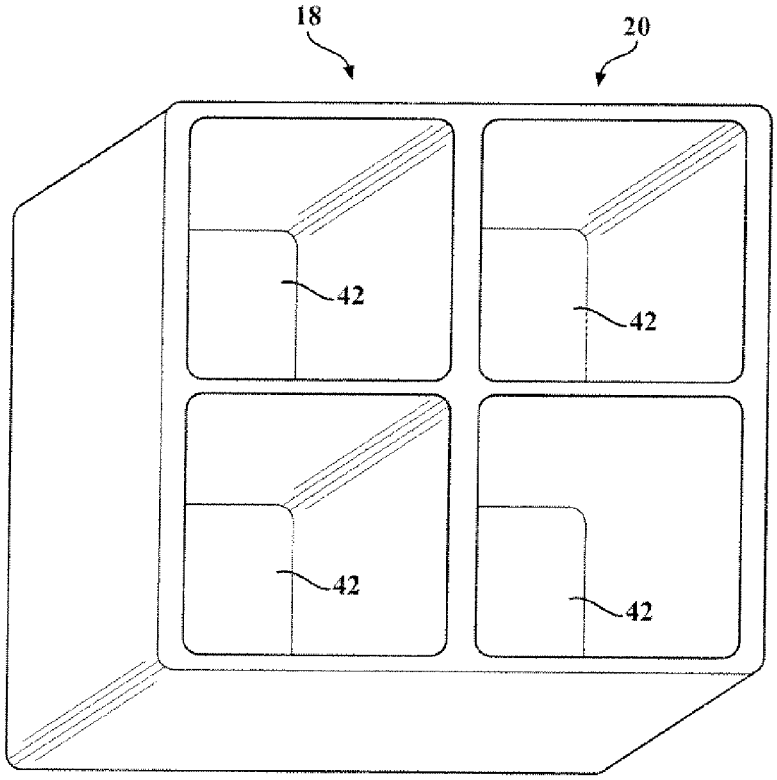
FIG. 4*a* shows a perspective view of a side block and a center block of the aluminum pallet of FIG. 1.
Figure 4B:
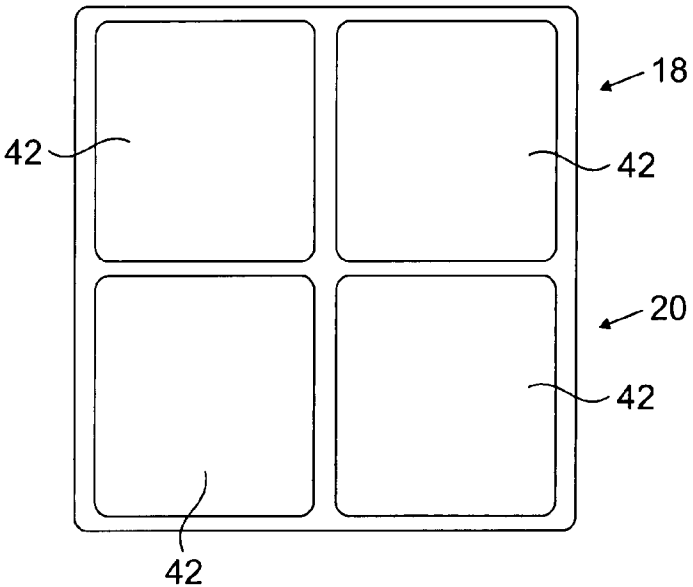
FIG. 4*b* shows an end view of the side block and the center block of FIG. 4*a*.

FIGS. 4*a* and 4*b* show a block used for the center block 20 and the four side blocks 18. The same block can be used for the side blocks 18 and the center block 20 or blocks having different structures can be used. The center and side blocks 18, 20 have an internal wall structure forming internal cells 42. The internal walls provide the center and side blocks 18, 20 with strength, stiffness and resistance to denting. The vertical axis orientation of the corner blocks 16, the side blocks 18, and the center block 20 provides the blocks with remarkable strength to allow the pallet 10 to support heavy loads.

Figure 5:
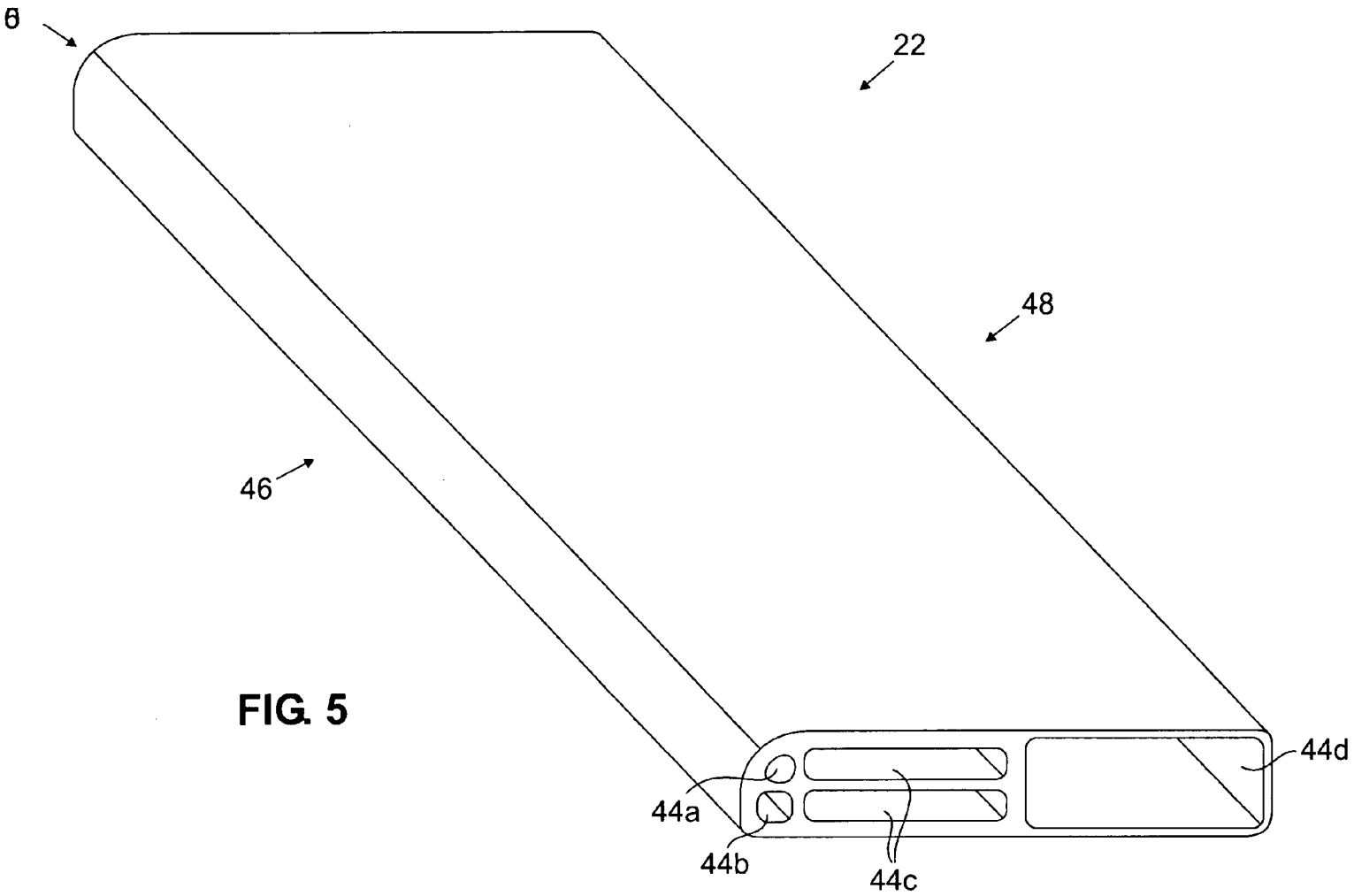
FIG. 5 shows a perspective view of a top side outer cross member of the aluminum pallet of FIG. 1.

FIG. 5 shows a top side outer cross member 22 used for the outer perimeter of the top side 12 of the pallet 10. The cross member 22 has an internal wall structure having vertical and horizontal internal walls forming internal cells 44*a*-d. The wall structure and internal cells 44*a-d* provide an outer portion 46 of the cross member 22 with increased strength and impact resistance since that portion 46 faces away from the pallet 10 and may be subject to greater risk of damage. The inner portion 48 of the cross member 22 may not have the internal walls to reduce costs since that portion 48 faces inward into the pallet 10. Also, the outer portion 46 of the cross member 22 has greater material thicknesses than the inner portion 48 of the cross member 22. The top, outer corner 50 of the cross member 22 is rounded. The structure of the cross member 22, particularly the internal wall and cell structure, allows the cross member 22 to elastically deform. When the cross member 22 is subjected to an impact, the cross member 22 tends to elastically deform and absorb the energy of the impact. The cross member 22 then returns to at least partially to its original shape as there may be some permanent or plastic deformation.

Figure 6B:
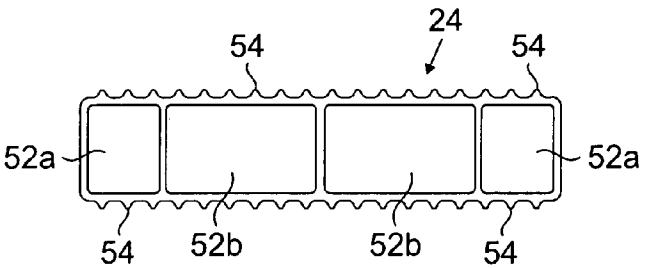
FIG. 6*b* shows an end view of the top side cruciform cross member of FIG. 6*a*.
Figure 6C:
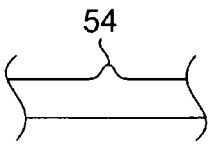
FIG. 6*c* shows a friction ridge of the top side cruciform cross member of FIG. 6*a*.
Figure 6A:
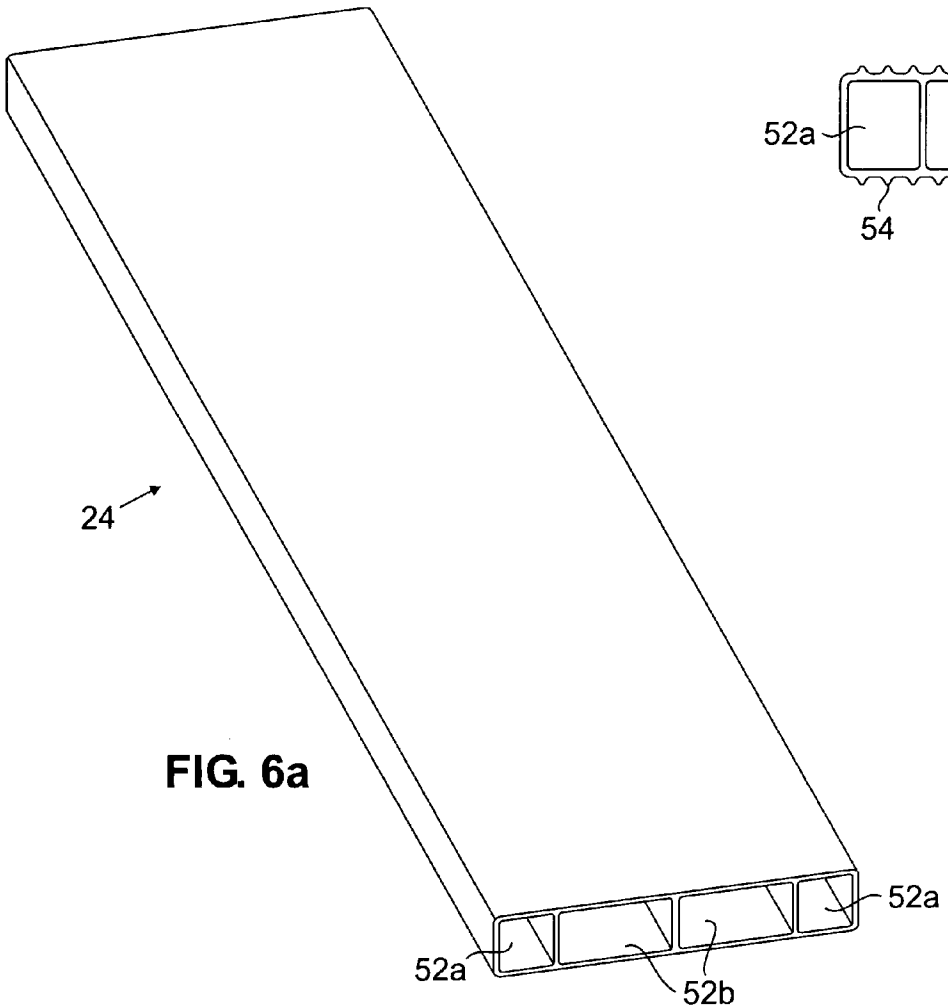
FIG. 6*a* shows a perspective view of a top side cruciform cross member of the aluminum pallet of FIG. 1.

FIGS. 6*a-c* show a cross member 24 which is a cruciform cross member on the top side 12 of the pallet 10. Four top side cruciform cross members 24 are connected to the center block 20, one on each side of the center block 20 as shown in FIG. 1. The four top side cruciform cross members 24 form a generally cruciform shape when connected to the center block 20. Referring to FIGS. 6*a*, 6*b*, the cruciform cross member 24 has an internal wall structure which forms internal cells 52*a, b*. The top side cruciform cross member 24 may have friction surfaces (top surface and/or bottom surface) similar to the friction surfaces.

Referring to FIGS. 6*b, c*, friction ridges 54 may be provided on the top face (and also the bottom face, if desired) of the top side cruciform member 24 or on any of the cross members 22, 24, 26, 28, 30. The friction ridges 54 can provide a friction surface for the load supported by the pallet 10 such that the load does not slip or slide on the pallet 10. The friction ridges may be aluminum protrusions from the surface of the cross member, such as about 0.3 mm ridges. Other mechanisms can be used to provide the surfaces with friction enhancement properties or components attached to the surface to enhance friction.

Figure 7:
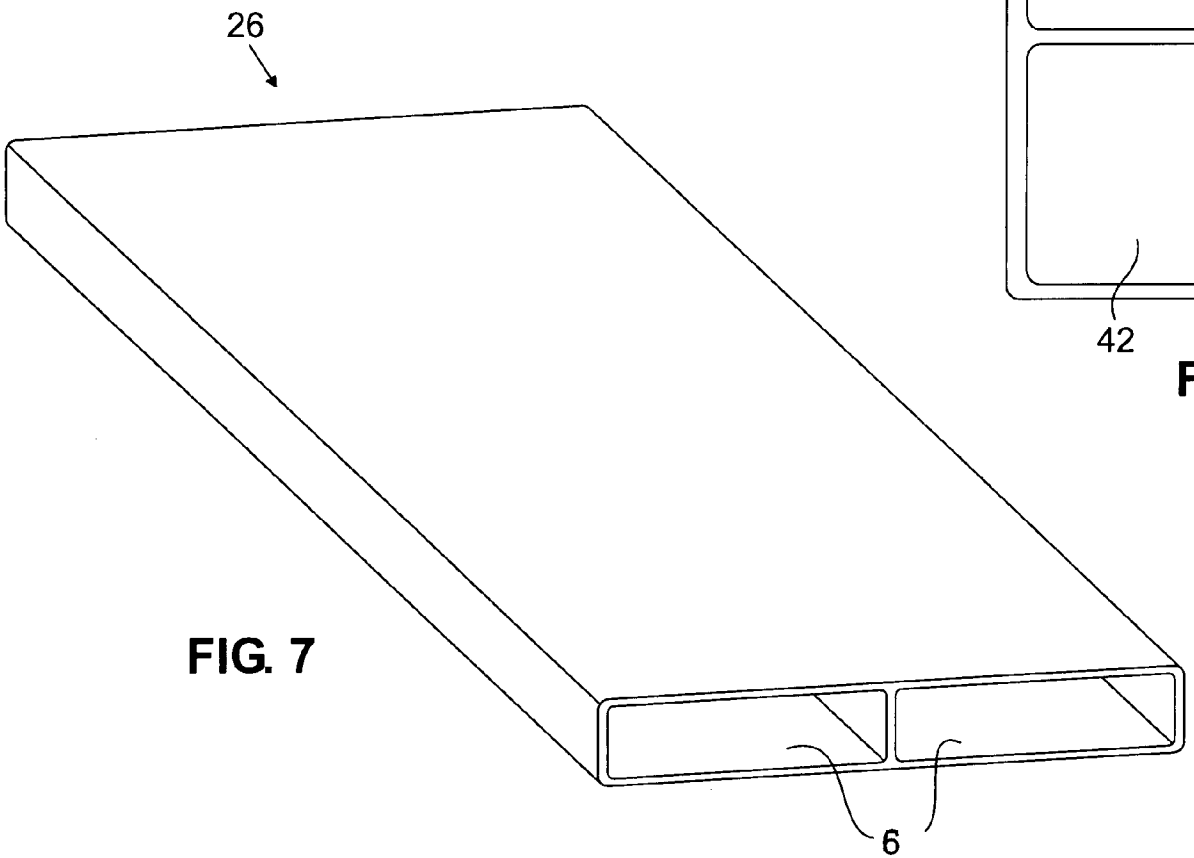
FIG. 7 shows a perspective view of a top side ladder cross member of the aluminum pallet of FIG. 1.

FIG. 7 shows a cross member 26 which is a ladder cross member for the top side of the pallet 10. The pallet 10 example of FIG. 1 has three groups of three ladder cross members 26 for a total of nine ladder cross members 26. The ladder cross members 26 are connected to the top side outer cross members 22 of FIG. 5 and to the top side cruciform cross members 24 of FIG. 6*a*. An internal wall structure of the ladder cross member 26 provides internal cells 56.

Figure 8B:
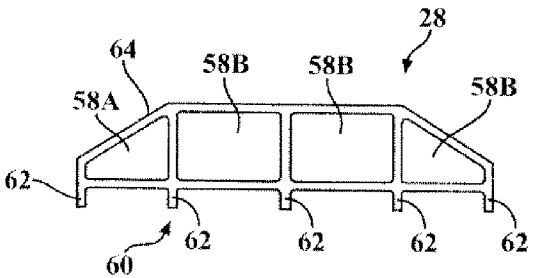
FIG. 8*b* shows an end view of the bottom side outer cross member of FIG. 8*a*.
Figure 8A:
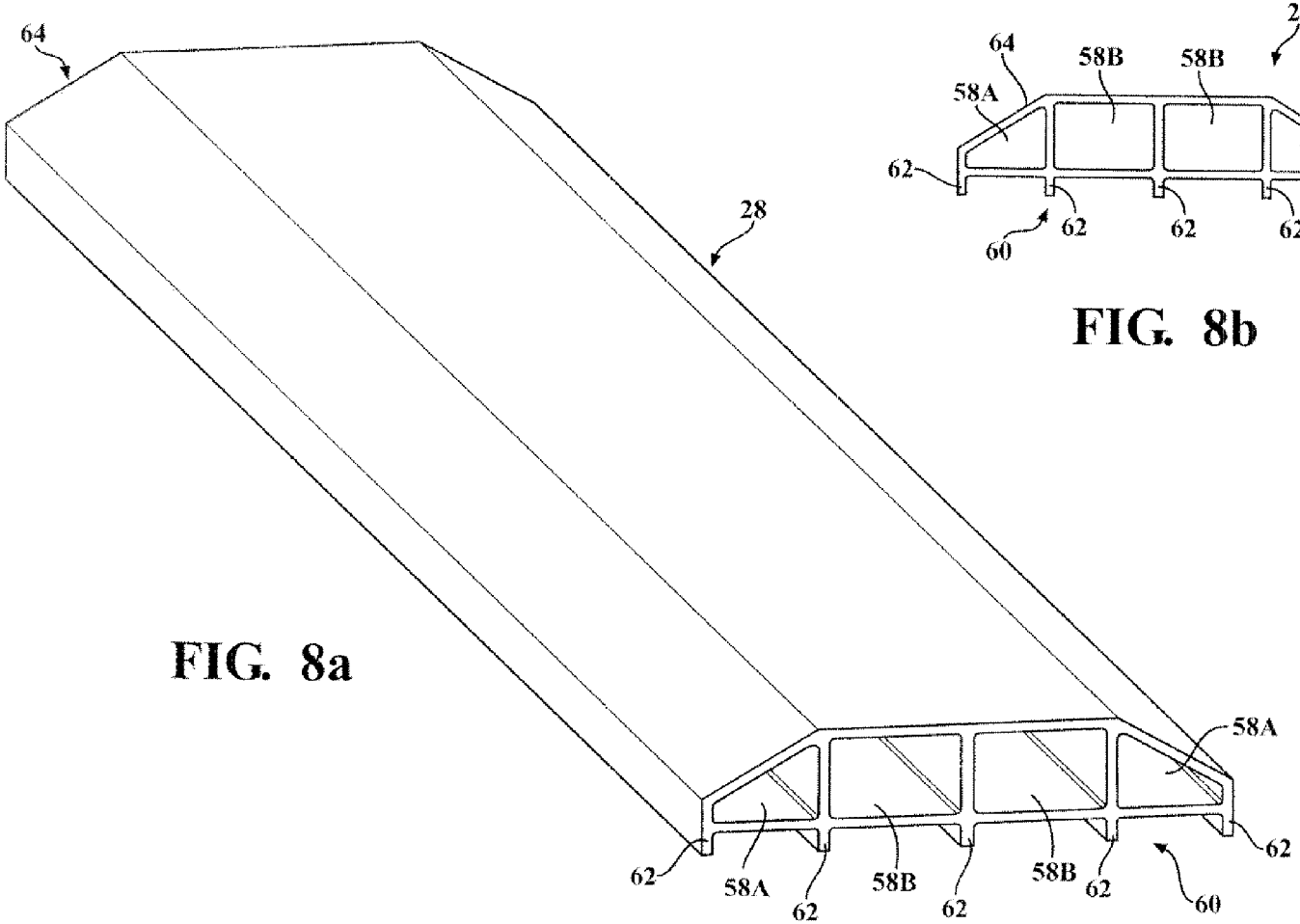
FIG. 8*a* shows a perspective view of a bottom side outer cross member of the aluminum pallet of FIG. 1.

FIGS. 8*a, b* show an outer cross member 28 used for the bottom side 14 of the pallet 10 as shown in FIG. 2. The cross member 28 has an internal wall structure forming internal cells 58*a, b*. The bottom face 60 of the bottom side outer cross member 28 has a plurality of exterior ribs 62 projecting downward. The exterior ribs 62 provide enhanced stiffening of the bottom side cross member 28. Also, the exterior ribs 62 provide the bottom side 14 of the pallet 10 with a friction surface to reduce or eliminate undesired slipping of the pallet 10 when resting on a surface. Of course, structures other than the exterior ribs 62 may be used or applied to the cross member 28 to provide the bottom side 14 of the pallet 10 with a friction enhanced surface.

Referring to FIG. 2, the bottom side outer cross member 28 of FIGS. 8*a, b* can also be used for the bottom side cruciform cross members 30. The bottom side cruciform cross members 30 can be the same or similar to the top side cruciform cross members 24 with or without the ribs 62 of FIG. 8*a* or other bottom side friction surface structure.

Various components of the pallet 10 have been described as having internal wall structures and internal cells. The internal wall structures and the internal cells of the various pallet components provide strength, stiffness and resistance to denting. Also, the tubular structure of the pallet components provides torsional stiffness and bending stiffness.

Referring to the embodiment shown in FIGS. 1 and 3-5, the top side outer cross member 22 is connected, e.g. welded, to the corner block 16 at one end and to the side block 18 at the opposite end. The top and bottom faces of the top side outer cross member 22 are generally horizontal and generally perpendicular to the corresponding generally vertical faces of the corner block 16 and the side block 18. The cross member 22 does not overlap or rest on the top sides of the corner and side blocks 16, 18. That structure along with the structure of the internal walls and cells of the blocks 16, 18 provides remarkable advantages. The structure provides the pallet 10 with remarkably tremendous strength for supporting loads on the pallet 10.

Additionally, when the cross member 22 is struck with an impact force at its outer edge portion 46, which faces away from the pallet, for example by a fork lift tine, the cross member 22 tends to elastically deform inward and then return to its original position. The internal cells of the corner block 16 and the center block 18 along with the structure of the cross member 22 connected to the blocks 16, 18 allows at least portions of the blocks 16, 18 to elastically twist as the cross member 22 bends inward toward the center of the pallet 10. The force of the impact is absorbed and the cross members 22 flex back outward and the blocks 16, 18 twist in the opposite direction to return to their original positions. The twisting internal cells of the blocks 16, 18 can be described as torque towers. In this manner, permanent damage to the pallet 10 can be reduced or eliminated. Also, the inventive structure allows the cross member 22 to remain "in plane" after an impact. If the impact load is sufficiently severe to cause permanent deformation of the cross member 22, the cross member 22 remarkably tends to remain within its original plane, that is, the cross member 22 does not tend to deform upwardly above the original plane of the top side 12 of the pallet 10. Prior pallets which deform out of plane have experienced difficulties with properly supporting a load on the pallet and with stacking of unloaded pallets. The present invention can provide the advantage of reducing out of plane deformations, which allows for proper load support and stacking of unloaded pallets.

Referring to FIGS. 1 and 8*a, b*, at least the top outer edge 64 of the bottom side outer cross member 28 is slanted downward. The top outer edge 64 could also be rounded or even have other configurations. The slanted or rounded edge 64 provides advantages. For example, the slanted or rounded edge 64 easily guides fork tines to ride on top of the bottom side cross members 28 when the fork tines are being inserted in the pallet 10. This reduces impacts and damage by the fork tines. Similarly, the bottom outer edge of the top side outer cross member of FIG. 5 can be rounded or slanted. The rounded or slanted edge also tends to reduce impact damage from fork tines by guiding the fork tines underneath the top side outer cross members 22 during inserting of the fork tines into the pallet 10.

Referring to FIGS. 1 and 2, all of the cross members (outer cross members 22, 28, cruciform cross members 24, 30, and ladder cross members 26) are welded closed in a fluid tight seal. The pallet components are hollow and it is desired to prevent water and other fluids or foreign bodies from entering and being retained within the internal portions of the components. The vertical axis orientation of the open ended corner, side and center blocks 16, 18, 20 allows for fluids and foreign bodies to pass through the blocks 16, 18. 20 without being retained within the blocks 16, 18, 20.

The cross members 22, 24, 26, 28, 30 and the blocks 16, 18, 20 may be connected together by other methods or mechanisms. For example, the joint between a cross member and a block may only be partially welded. The remaining portion of the joint may be sealed by another means. Examples of some other sealants include spray on sealants, glues and caulk type sealants. Such sealants could also be applied to the welded portion of the joint, if desired.

As described above and shown in the drawings, the blocks 16, 18, 20 and cross members 22, 24, 26, 28, 30 have various internal wall structures and external walls. The material thicknesses of the walls are defined to provide the pallet 10 with sufficient properties, such as strength, stiffness and impact resistance, suitable for the pallet's intended use. The material thicknesses of the walls is defined thin enough to reduce the costs of the pallet 10, yet thick enough to provide the desired properties of the pallet 10. Different portions of any particular block or cross member may have a different thickness than another portion of the particular block or cross member. For example, the walls of the corner blocks 16 that face outwardly from the pallet 10 may have a greater material thickness than the walls of the corner block 16 that face inwardly. The cross members may also have different portions which have different wall thicknesses.

Different aluminum alloys can be used for different components of the aluminum pallet 10. For example, a high strength aluminum alloy may be used for the corner blocks 16 and the side blocks 18 around the outer perimeter of the pallet 10 and for the cross members 22, 28 around the outer perimeter of the pallet 10. A lower strength aluminum alloy may be used for the center block 20 and for the cross members 24, 30 and the ladder members 26 positioned inside of the outer perimeter of the pallet 10. The high strength aluminum allow provides strength, stiffness and impact resistance to the more damage vulnerable perimeter of the pallet 10. The relatively lower strength allow, such as a standard strength aluminum allow, can be used for portions of the pallet 10 which are not subject to as intense of abuse or damage. The relatively lower strength aluminum allow may be easier to manufacture into the desired components and thus, be a lower cost material.

An embodiment example of the pallet 10 is described as having the components welded together. Any suitable welding method can be used to assemble the pallet components. For example, conventional welding, pulsed MIG welding, arc welding, and laser welding, and other welding methods can be used to make the pallet 10. Furthermore, other suitable material bonding methods are contemplated by the present invention which are suitable for the particular materials selected for the pallet 10.

Figure 9:
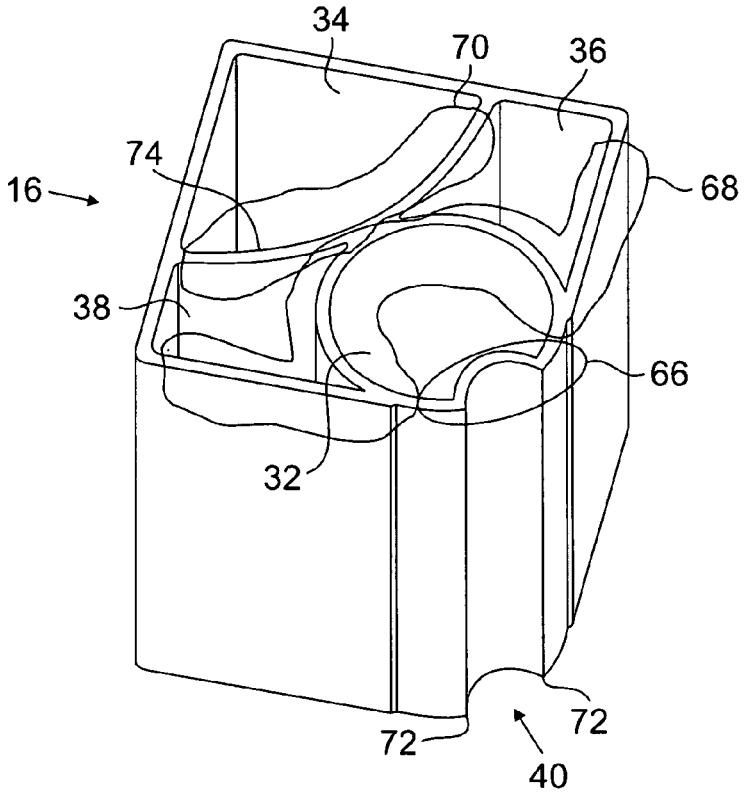
FIG. 9 shows another perspective view of the corner block of FIG. 3.

FIG. 9 provides further disclosure of the internal cells and crush cells 32-38 of the corner block 16 of FIG. 3. The corner block 16 has three crush zones 66, 68, 70. Crush zone 1 (66) is a region of the inward curved corner 40 so that the two vertical ends 72 of the curved region initially curl inwards upon impact. Subsequently, the two ends 72 can open up as crush zone 2 (68) flattens upon further impact. Crush zone 2 (68) has the cylindrical shaped crush cell 32 which flattens considerably during a second or deeper impact and absorbs the impact energy. Crush zone 3 (70) has a curved wall 74 of the crush cell 34 which caves in and deforms in a third or deeper impact and absorbs the impact energy. In this manner, the multiple crush zones 66, 68, 70 and the crush cells 32, 34 of the corner block 16 can absorb impact energy and reduce damage to the pallet 10.

Figure 10:
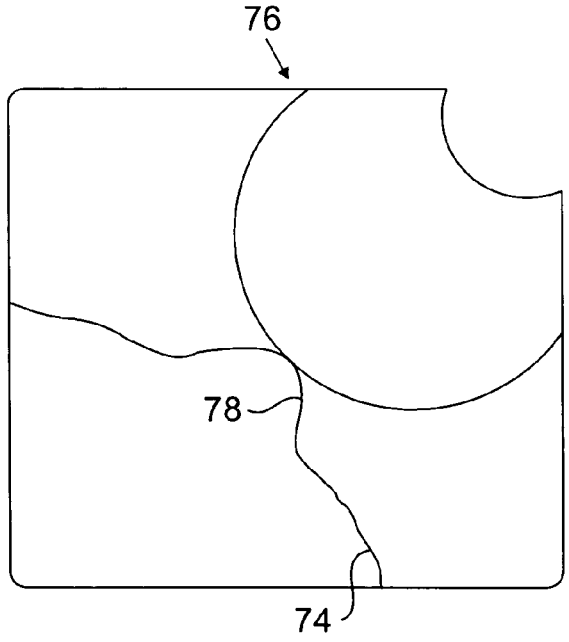
FIG. 10 shows a schematic top view of another corner block of the aluminum pallet.

FIG. 10 shows a schematic view of another corner block 76 of the present invention. The corner block 76 is similar to the corner block 16 of FIG. 9; however, the crush zone 3 (70) has a modified configuration. The wall 74 of crush zone 3 (70) has a curved bulged wall portion 78 which tends to straighten during deformation as crush zone 3 (70) absorbs energy.

Figure 11B:
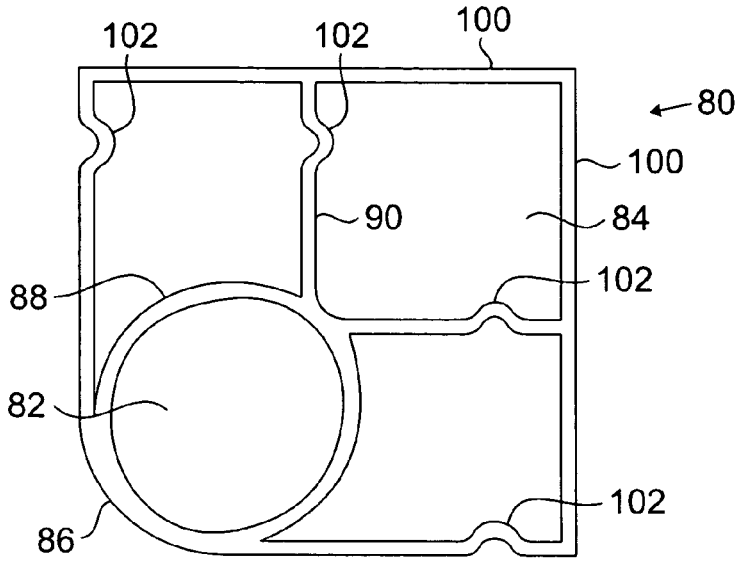
FIG. 11*b* shows a top view of the corner block of FIG. 11*a*.
Figure 11A:
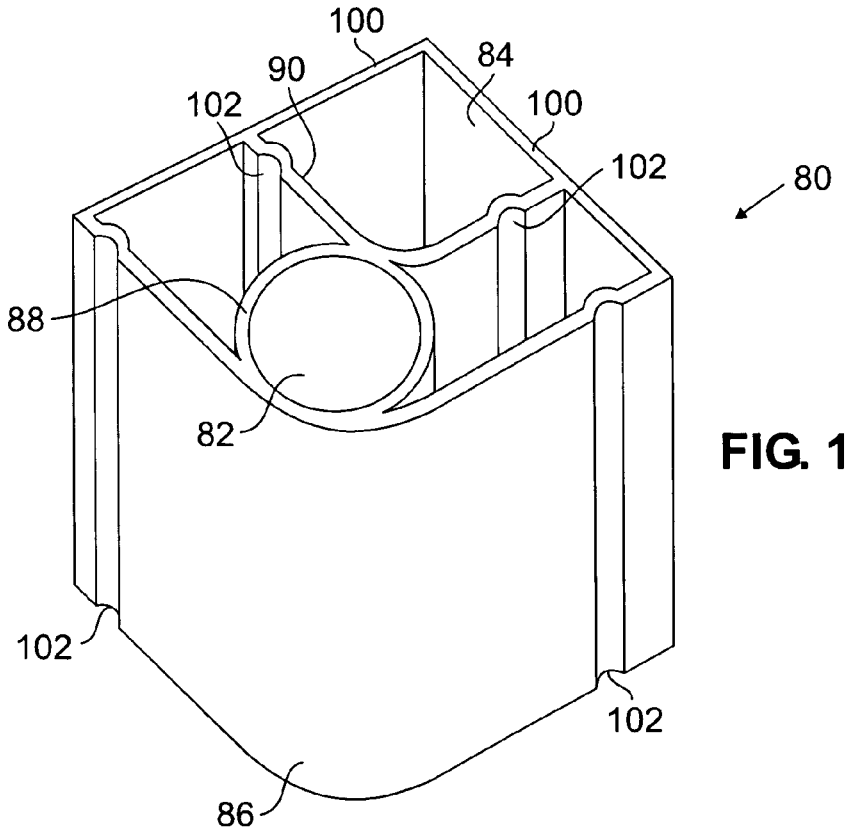
FIG. 11*a* shows a perspective view of another corner block according to the present invention.

FIGS. 11*a, b* show another corner block 80 of the present invention. The corner block 80 has two crush cells 82, 84. Crush cell 82 is formed by the outer rounded corner 86 and an internal cylindrical-shaped wall 88. The crush cell 82 has a generally circular shape. Crush cell 82 is adjacent crush cell 84. Crush cell 84 is formed by an internal wall 90 joined to outer walls 100. The crush cell 84 has a generally square shape in this embodiment. The crush cells 82, 84 are arranged sequentially from the corner 86 inward toward the inner opposite corner of the corner block 80.

The crush cells, such as the circular-shaped crush cell 82, predominantly flatten out upon impact. This is a desirable deformation or bending mode for energy absorption to reduce damage to the pallet 10. By providing the crush cells in the corner blocks of the pallet, impact forces to the pallet are dissipated in the corner blocks by crushing the crush cells. Therefore, the forces and loads transmitted to the joints between the pallet components, e.g. welded joints between the blocks and the cross members, are minimized. Also, the structure of the blocks having crush cells typically results in lighter weight blocks.

One or more grooves 102 can be provided at any desired location of the corner block 80. The grooves 102 provide free bending of the walls of the corner block 80 with reduced or no wall stretching. The grooves 102 on the walls act as hinges to allow the free inward bending of the walls upon impact on the corner 86. The grooves 102 also allow for the walls to lengthen without inducing stretch which typically causes fracture in materials, particularly, aluminum or plastic. Accordingly, the grooves 102 enhance the ability of the corner block 80 to absorb energy and reduce impact damage to the corner block 80 and the pallet 10. The grooves 102 are shown as projecting inward. However, the grooves 102 could project outward if desired.

Figure 11C:
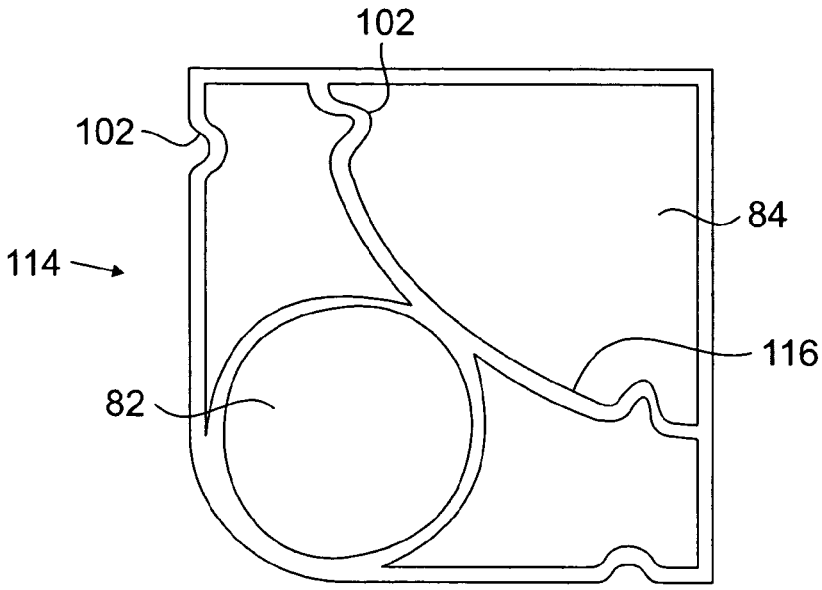
FIG. 11*c* shows a top end view of a variation of the corner block of FIG. 11*a*.

FIG. 11*c* is a top end view showing one alternative embodiment of the corner block 80 of FIGS. 11*a, b*. The corner block 114 of FIG. 11*c* has a wall 116 which has a larger curve radius than the wall 90 of the corner block 80. The crush cell 84 has a quadrant shape which may result in more uniform deformation without concentrating deformation forces at a corner of a square-shaped crush cell. The other features of the corner block 114 are the same as the corner block 80.

FIGS. 12*a-d* are schematic illustrations showing crush modes of the corner block 114 of FIG. 11*c*. When the corner block 114 is subjected to multiple corner impacts, the corner block 114 undergoes progressive yet controlled crush in the manner shown in the illustrations.

Figure 12B:
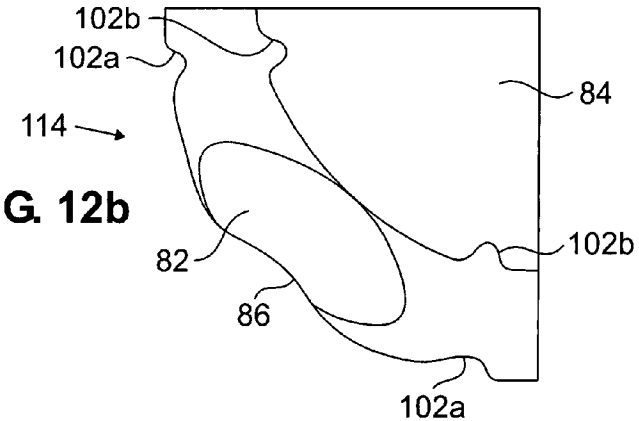
FIGS. 12*a-d* are schematic illustrations showing crush modes of the corner block of FIG. 11*c*.
Figure 12D:
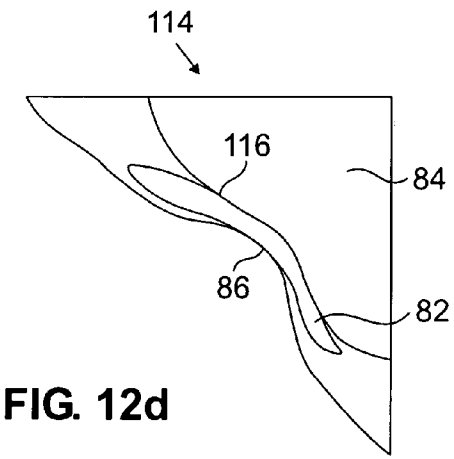
Figure 12A:
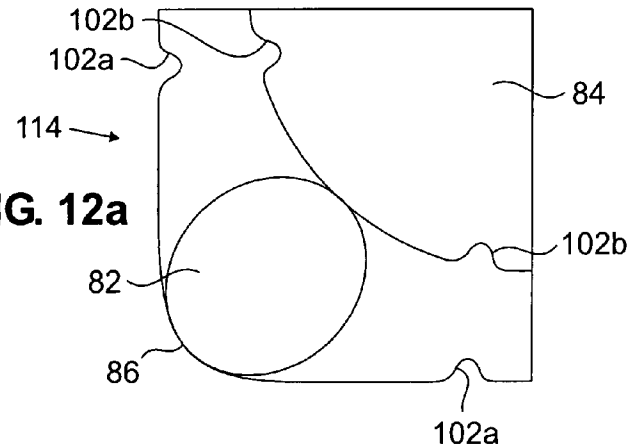

FIG. 12*a* is a top end schematic view of the corner block 114 prior to entering a crush mode. The crush cells 82, 84 are not deformed. Also, the grooves 102 are also not deformed as well.

FIG. 12*b* is a schematic illustration of the corner block 114 in a crush mode after a first impact. The crush cell 82 is deformed due to the impact and absorbs the impact energy. The crush cell 82 partially flattens and the outside walls of the corner block 114 bend inwards at the grooves 102*a*.

Figure 12C:
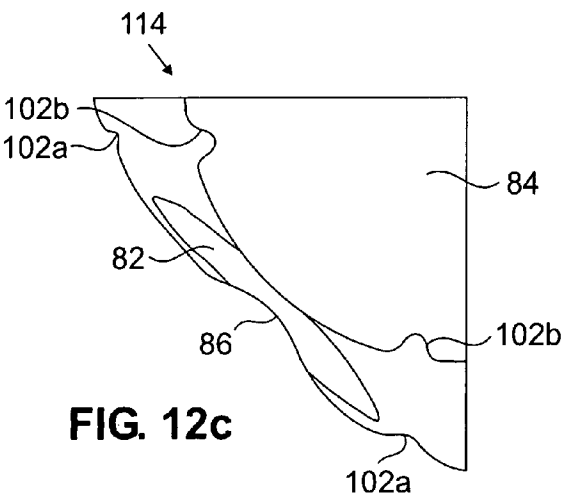

FIG. 12*c* is a schematic illustration of the corner block 114 in the crush mode after a second impact. The crush cell 82 has deformed further in a flattened manner. The corner 86 may be deformed inwards. The grooves 102*a* in the outer wall have partially straightened.

FIG. 12*d* is a schematic illustration of the corner block 114 in the crush mode after a third impact. The crush cell 82 has deformed even further, and the crush cell 84 has also deformed. The curved wall 116 of the quadrant crush cell 84 is deformed inward. The grooves 102*b* have also deformed or straightened.

The grooves 102 tend to change shape during the crush mode. A particular groove 102 may partially or completely close and/or partially or completely straighten. The groove 102 may change shape to be more closed and then subsequently further change shape to straighten, and vise versa.

Therefore, the corner block 114 is capable of absorbing three corner impacts without transferring excessive loads to the joints of the pallet components. Also, the walls of the blocks that are connected to the cross members can be preserved as being flat. Further, the corner block 114 provides for (a) inward crushing of the corner portion 86 and (b) the top and bottom surfaces of the corner block 114 remain in-plane (i.e., no bulging outward). Therefore the pallet 10 is reusable even after multiple impacts as the deformation and forces are largely contained in the corner block 114 itself.

FIGS. 12*a-d* show the progression of the crush mode through activation of the sequential crush cells 82, 84. Although the crush mode is described with reference to three impacts, fewer or more impacts may be required to progress through the crush mode. The crush modes of the other corner block embodiments are similar to the crush modes described with reference to FIGS. 12*a-d*.

Figure 13C:
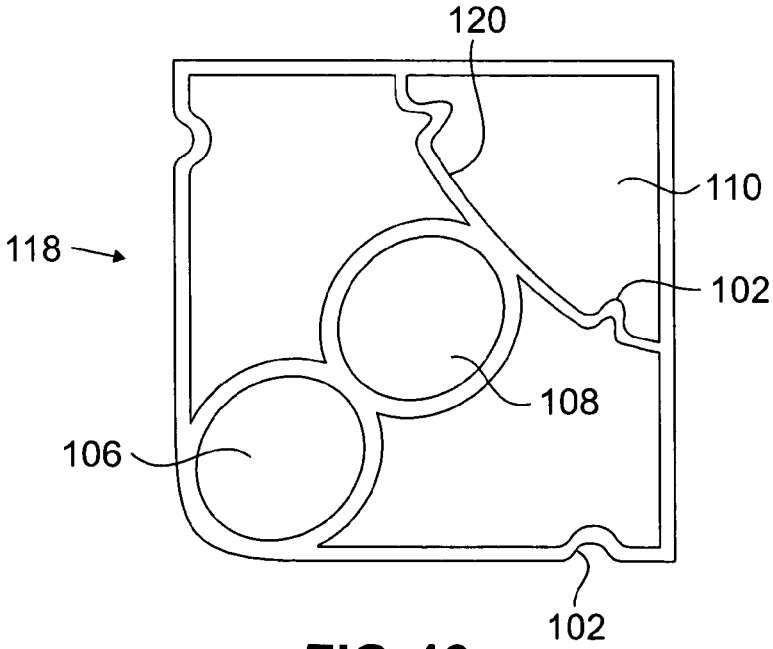
FIG. 13*c* shows a top end view of a variation of the corner block of FIG. 13*a*.
Figure 13B:
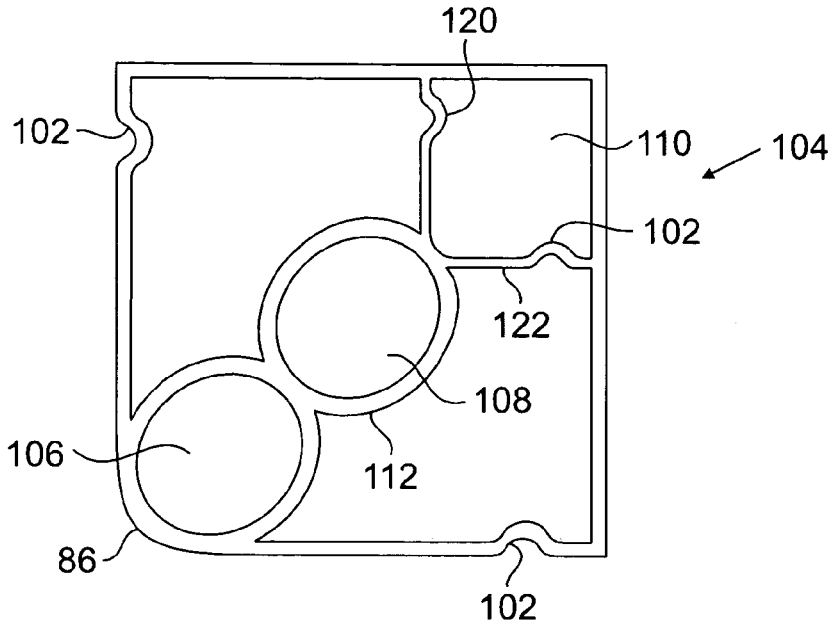
FIG. 13*b* shows a top view of the corner block of FIG. 13*a*.
Figure 13A:
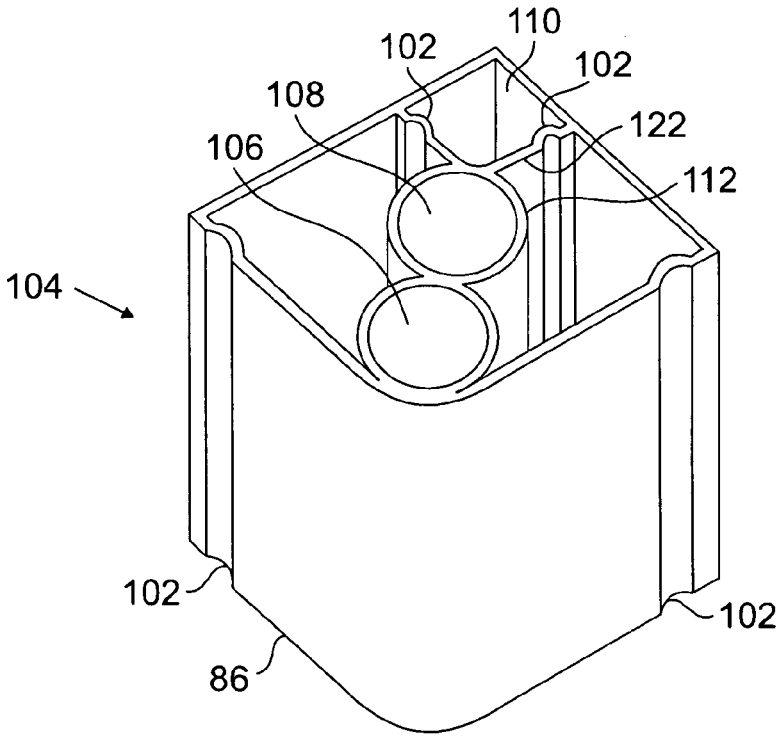
FIG. 13*a* shows a perspective view of another corner block according to the present invention.

FIGS. 13*a, b* show another corner block 104 of the present invention. The corner block 104 is similar to the corner block 80 of FIG. 11*a, b*, except corner block 104 has three crush cells 106, 108, 110. Crush cell 106 corresponds to crush cell 82 of the corner block 80. Crush cell 110 of the corner block 104 corresponds to the crush cell 84 of the corner block 80. The corner block 104 has an additional crush cell 108 between its crush cells 106 and 110. Crush cell 108 is formed by a cylindrical shaped internal wall 112 and is adjacent crush cells 106 and 110. The crush cells are arranged sequentially from the outer corner 86 inward into the corner block 104. The crush cells 106, 108 can be described as having a generally circular-shape and the crush cell 110 can be described as having a generally square-shape. One or more grooves 102 can also be provided on the corner block.

FIG. 13*c* is a top end view showing one alternative embodiment of the corner block 104 of FIGS. 13*a, b*. The corner block 118 of FIG. 13*c* has a wall 120 which has a larger curve radius than a corresponding wall 122 of the corner block 104. The crush cell 110 has a quadrant shape which may result in more uniform deformation without concentrating deformation forces at a corner of a square-shaped crush cell. The other features of the corner block 118 are the same as the corner block 104.

Figure 14A:
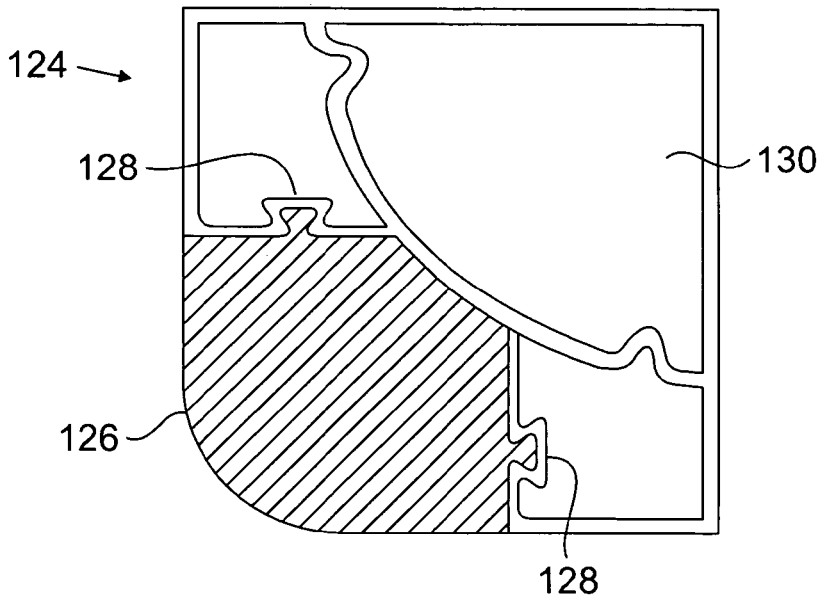
FIG. 14*a* shows a top end view of another corner block according to the present invention.

FIG. 14*a* shows a top end view of another corner block 124 according to the present invention. The corner block 124 has a bumper 126 at its outer corner. The bumper 126 is resilient and can be made out of rubber or other elastic materials, for example. The bumper 126 can be attached to the corner block 124 by any desired method or structure. For example, the bumper 126 is attached to the wall structure of the corner block 124 at attachment locations 128. The attachment locations 128 can have tabs engaged with channels in a vertical orientation as shown in FIG. 14*a*. Glue, fasteners, etc. can be used to attach the bumper 126 to the corner block 124. The bumper 126 can be removably or permanently attached to the corner block 128.

The bumper 126 absorbs energy from impacts to the pallet by compressing elastically and then releasing the energy to recover and return to its original shape. Pallet damage particularly caused by light impacts is reduced or eliminated by the bumper 126.

The corner block 124 also has a crush cell 130. When the corner block 124 is subjected to a relatively severe impact greater than the light impact absorbed by the bumper 126, the crush cell 130 deforms, absorbs impact energy, and reduces or eliminates damage to the pallet.

Figure 14B:
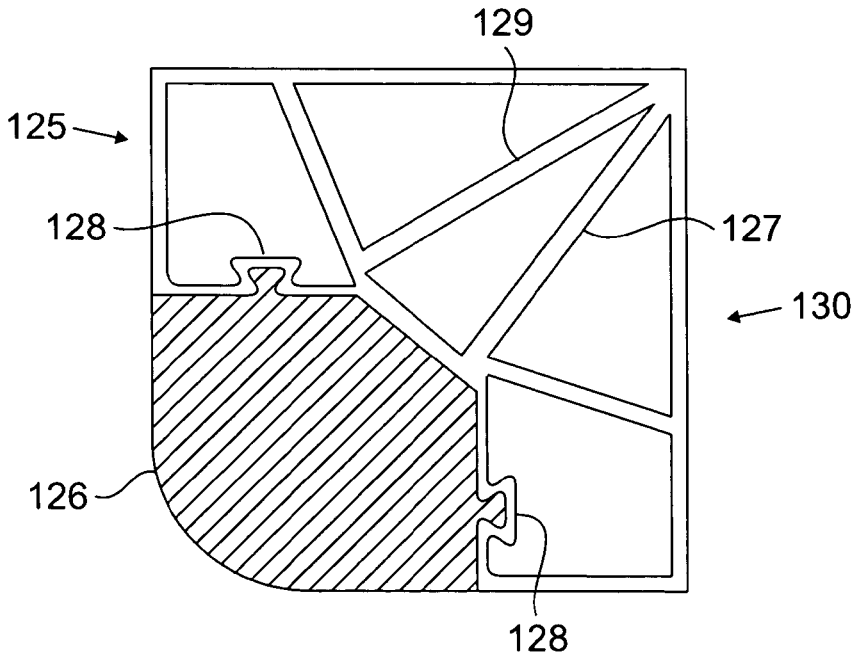
FIG. 14*b* shows a top end view of another corner block according to the present invention.

FIG. 14*b* is a top view of another corner block 125 according to the present invention. The corner block 125 is similar to the corner block 124 of FIG. 14*a* and has the resilient bumper 126. The corner block 125 also has walls 127, 129 which can reinforce and strengthen the internal crush cell 130. The degree of reinforcement of the crush cell 130 can be varied as desired depending on the structure and strength of the walls 127, 129. The walls 127, 129 can even prevent the crush cell 130 from crushing. In that embodiment, the resilient bumper 126 can serve as the crush cell and can return to its undeformed shape after deforming during impact. The crush cells of other embodiments of the invention can be strengthened by walls similar to the walls 127, 129 or by other suitable structures.

Figure 15:
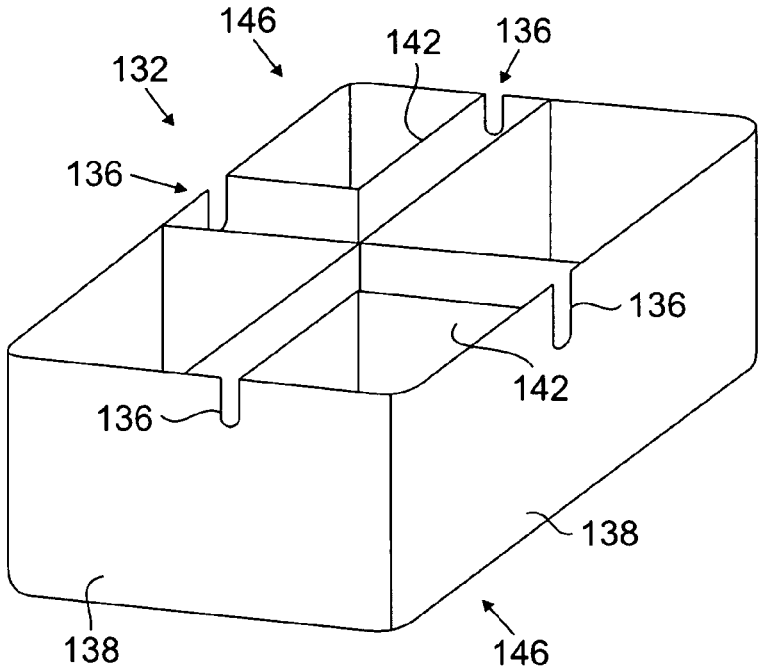
FIG. 15 shows a schematic perspective view of another corner block according to the present invention.
Figure 16:
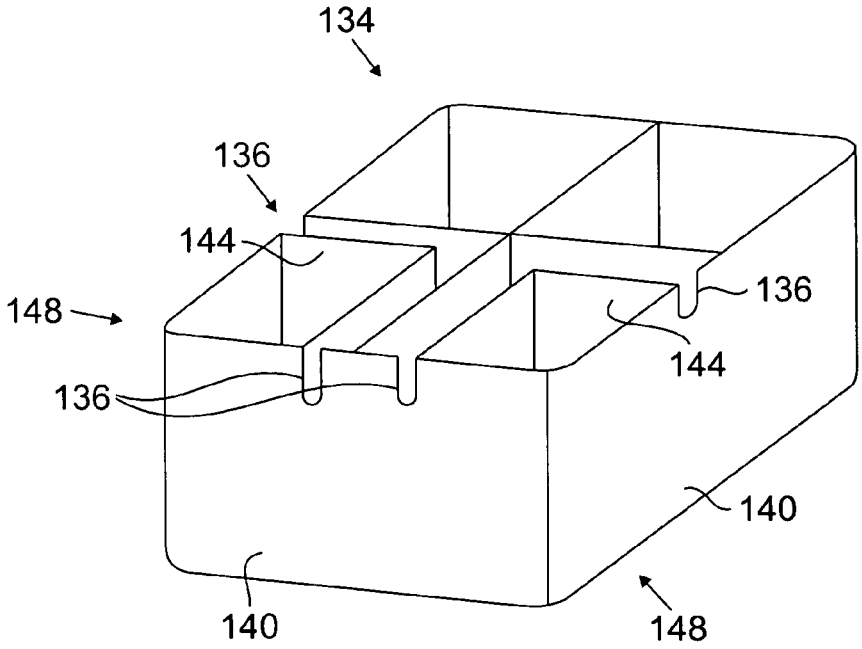
FIG. 16 shows a schematic perspective view of another outer side block according to the present invention.

FIG. 15 shows a schematic perspective view of another corner block 132 according to the present invention. FIG. 16 shows a schematic perspective view of another side block 134 according to the present invention. The side block 134 corresponds to the side block 18 of FIG. 1 and is positioned at the outer perimeter of the pallet 10 and between the corner blocks 132. The corner block 132 and the side block 134 have notches 136 in their outer walls 138, 140. Internal walls 142, 144 are connected to the outer walls 138, 140 adjacent the notches 136. Referring to FIG. 15, the inner wall 142 and the portions of the outer wall 138 between the notches 136 form a torque tower 146 of the corner block 132. Similarly, the inner wall 144 and the portions of the outer wall 140 between the notches 136 form a torque tower 148 of the side block 134 of FIG. 16. Pallet cross members, particularly the top side outer cross members, are connected to the torque towers 146, 148. The torque towers 146, 148 twist and deform elastically when the pallet 10 is subjected to an impact. The torque towers 146, 148 can reduce damage caused to the pallet 10 by absorbing energy and deforming at least partially elastically.

The pallet 10 shown in FIGS. 1 and 2 has corner blocks 16, side blocks 18, and a center block 20 which are open from the top side 12 of the pallet 10 to the bottom side 14 of the pallet 10. However, the pallet 10 can have any of the blocks constructed to be partially or fully closed at the top side 12 and/or the bottom side 14.

Figure 18:
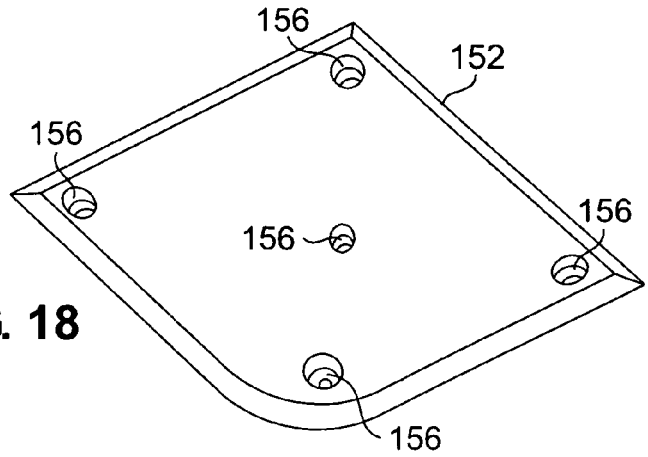
FIG. 18 shows a perspective view of a top cap for the corner block of FIG. 17.
Figure 17:
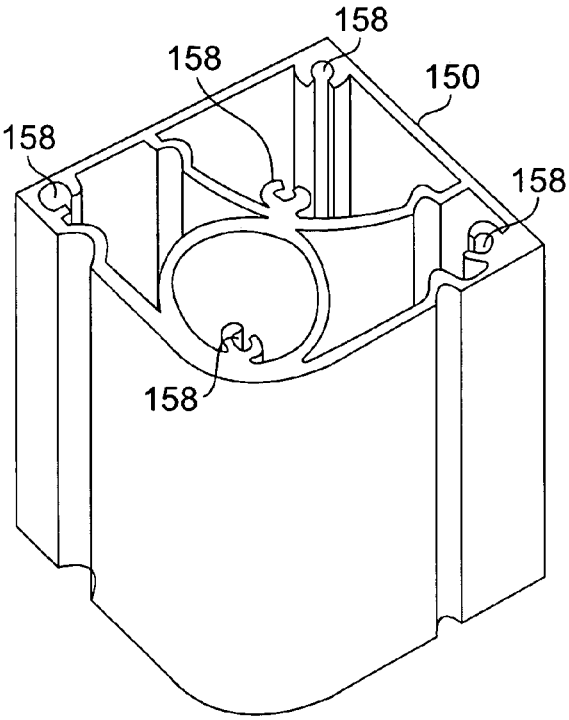
FIG. 17 shows a perspective view of another corner block according to the present invention.
Figure 19:
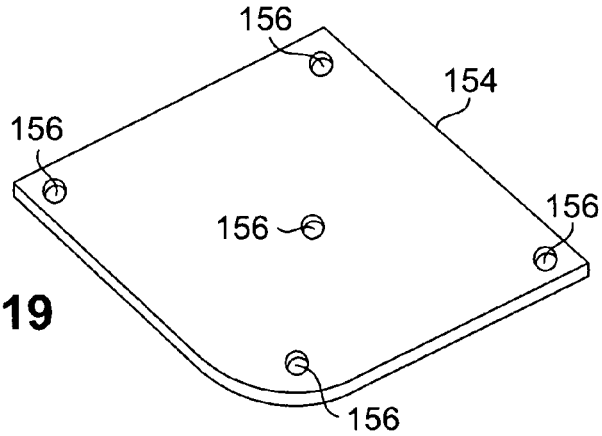
FIG. 19 shows a perspective view of a bottom cap for the corner block of FIG. 17.

FIGS. 17-19 show corner block 150 having a top cap 152 and a bottom cap 154. In this embodiment, the bottom cap 154 is another top cap 152, just flipped upside down. The top and bottom caps 152, 154 can be assembled to the corner block 150 in any desired manner. For example, fasteners can extend through fastener holes 156 and engage with fastener receivers 158 of the corner block 150.

The top and bottom caps 152, 154 can be made of rubber, plastic or any other material suitable for a desired purpose of the caps. The top and bottom caps 152. 154 may provide the functions of a) covering sharp edges of an open block, b) increasing friction on the top and bottom sides 12, 14 of the pallet 10, c) reducing noise produced while moving the pallet 10 around or while the pallet 10 travels on conveyors with metal rollers, and d) increasing the surface area to support the load on the pallet 10 itself. The top and bottom caps 152, 154 can provide other functions as well.

Figure 20:
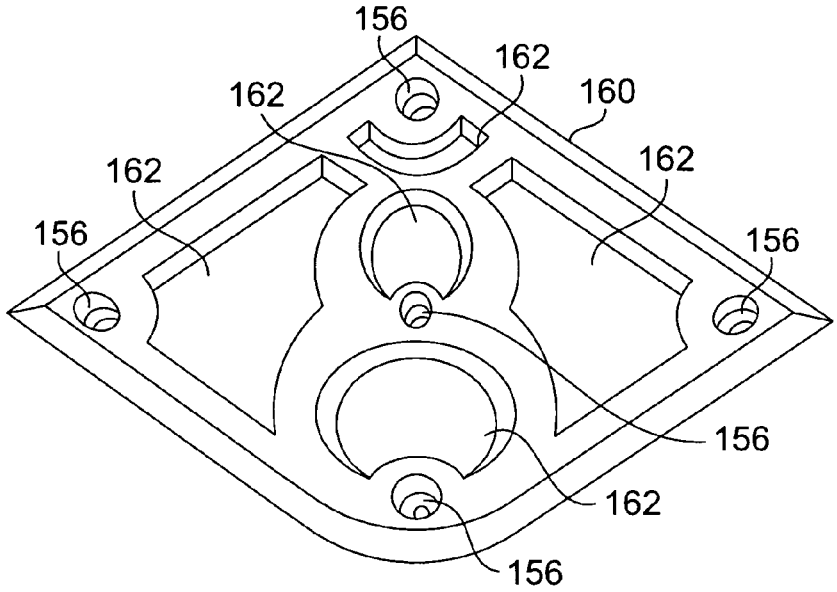
FIG. 20 shows a perspective view of another top cap for the corner block of FIG. 17.

The top and bottom caps 152, 154 are solid, i.e. the caps do not have openings other than the fastener openings 158. In another embodiment, FIG. 20 shows a block cap 160 having cutouts or openings 162. The cutouts 162 allow for the block cap 160 to crush or deform along with the block it is attached to. The block cap 160 can deform without any out of plane bulging or deforming.

Figure 21:
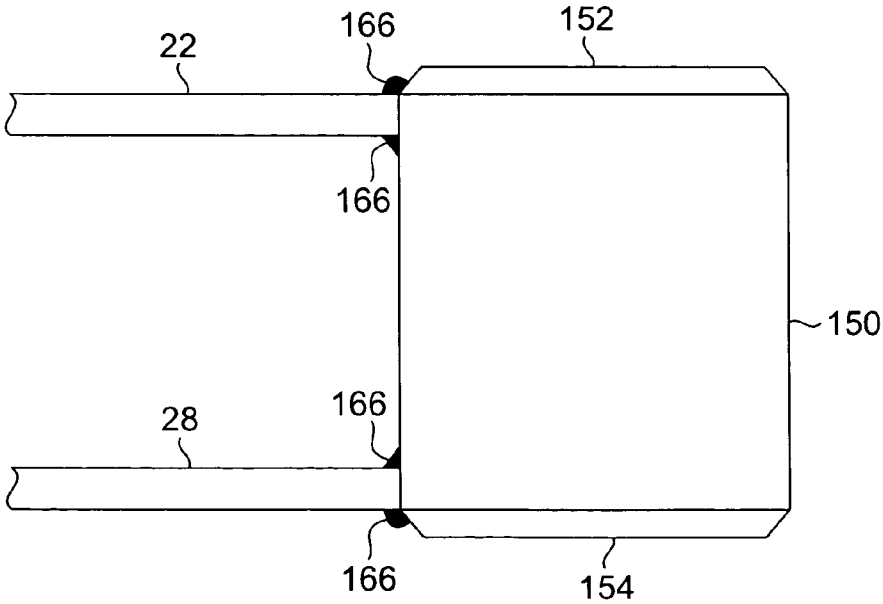
FIG. 21 is a schematic view of a corner block assembled to cross members.

FIG. 21 shows a schematic illustration of a corner block assembly 164. The corner block assembly 164 has the corner block 150 of FIG. 17 assembled with the top cap 152 of FIG.

18 and the bottom cap 154 of FIG. 19. Cross member 22, 28 are but-welded at weld locations 166. One feature of providing the top and bottom caps 152, 154 is that the weld material at the weld locations 166 does not interfere with items placed on top of the pallet 10 or interfere with a surface underneath the pallet 10.

Figure 22:
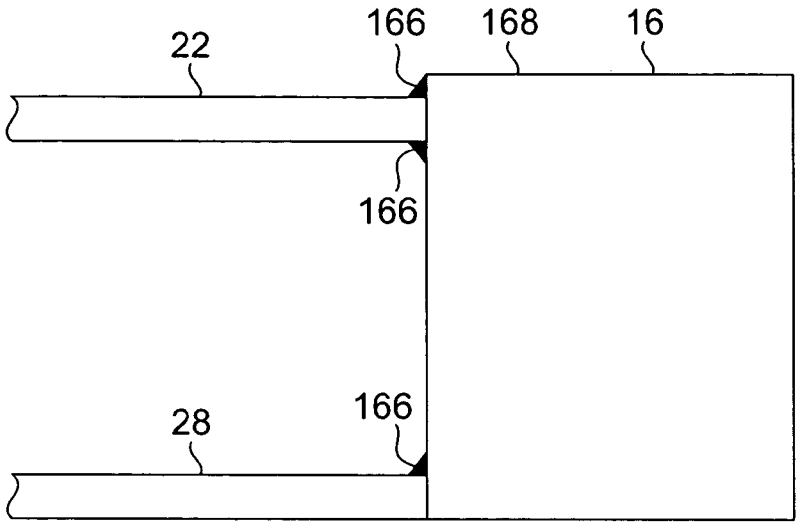
FIG. 22 is another schematic view of a corner block assembled to cross members.

FIG. 22 shows a schematic view of a corner block 16 fillet-welded to cross members 22, 28 at weld locations 166. The top side cross member 22 is positioned offset downward from the top edge 168 of the corner block 16. The offset position of the top side cross member 22 allows the weld material from the fillet weld at the top edge 168 to be below the top edge 168 and not interfere with items placed on the pallet 10.

Figure 23:
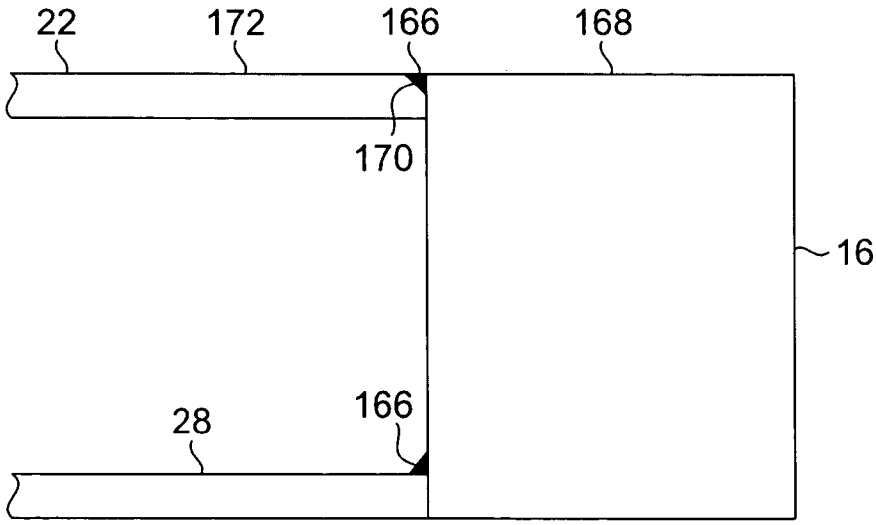
FIG. 23 is another schematic view of a corner block assembled to cross members.

FIG. 23 shows a schematic view of another welding structure of the corner block 16 welded to cross members 22, 28 at weld locations 166. The top side cross member 22 has a crimped edge 170 adjacent the corner block 16 for welding. The crimped edge 170 allows the weld material from the to be below the top edge 168 and not interfere with items placed on the pallet 10. Also, the top surface 172 of the cross member 22 is flush with the top edge 168 of the corner block 16.

The present invention also contemplates other welding and assembly structures of the pallet 10.

Figure 24:
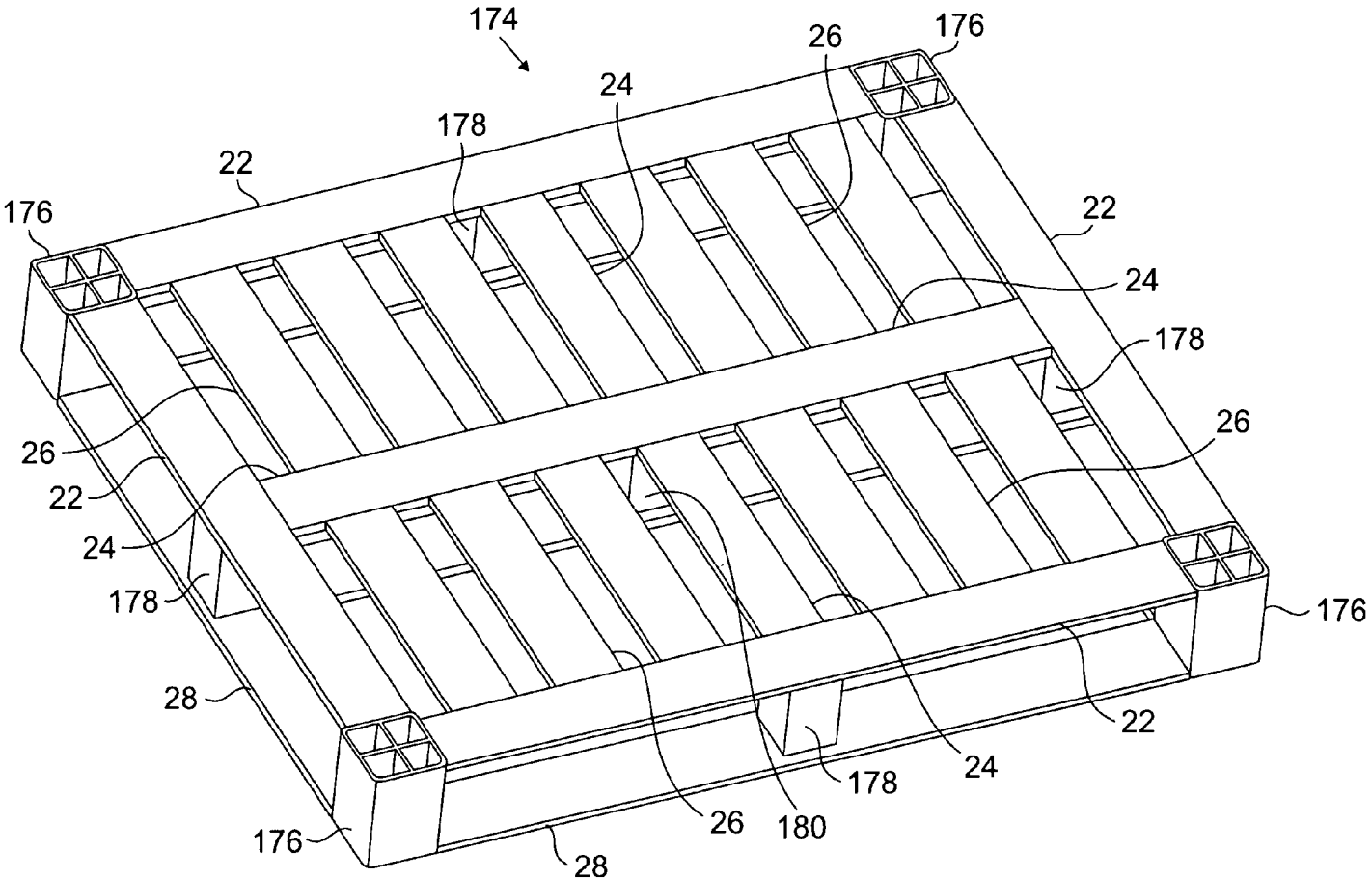
FIG. 24 shows a top perspective view of another pallet according to the present invention.
Figure 25:
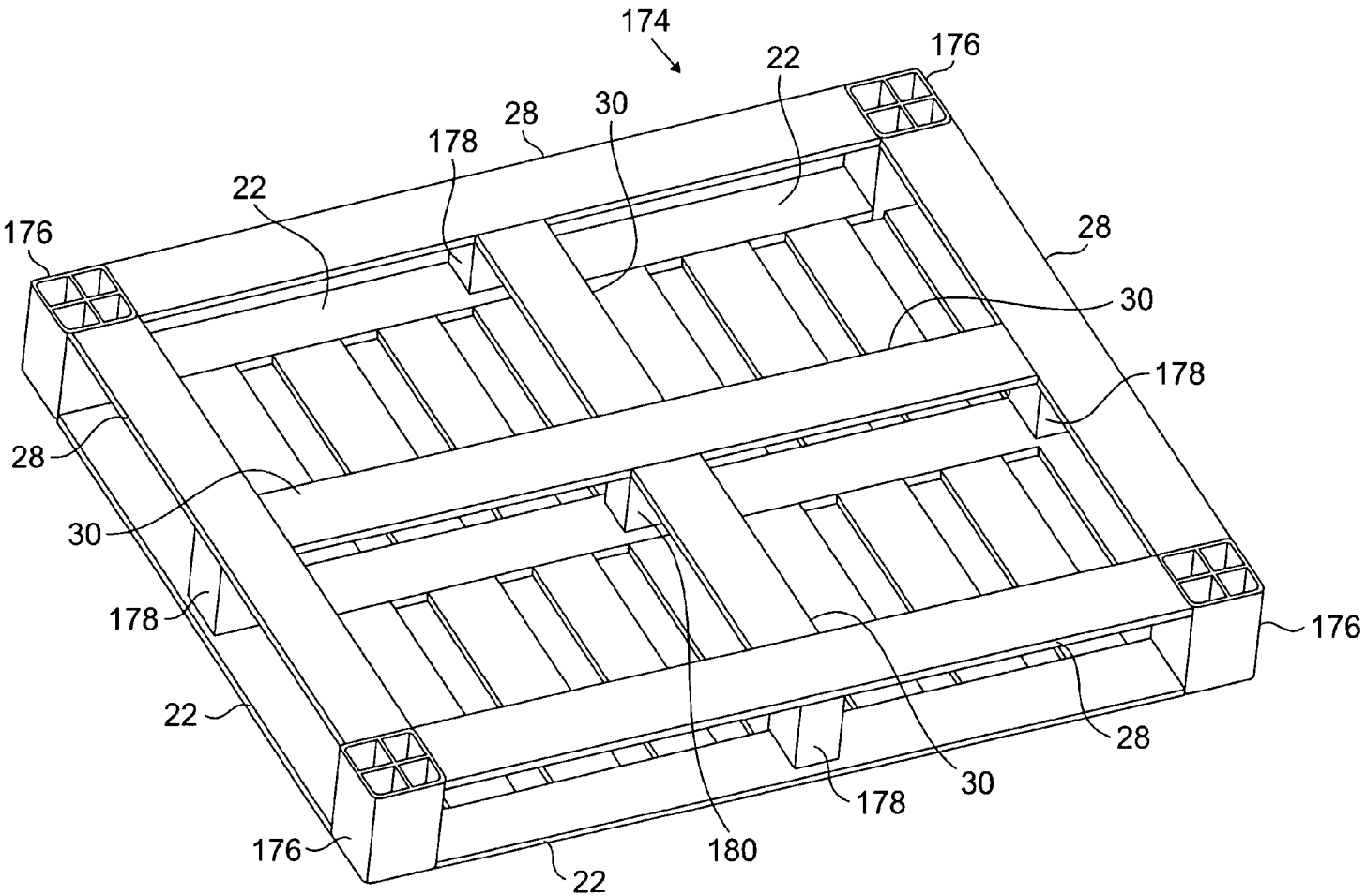
FIG. 25 shows a bottom perspective view of the pallet of FIG. 24.

FIGS. 24 and 25 show an aluminum pallet 174 which has various features similar to the features of the aluminum pallet 10 shown in FIGS. 1-8. The pallet 174 has corner blocks 176, side blocks 178 and a center block 180. The side blocks 178 and the center block 180 have the same general structure of their respective corresponding blocks as described herein. However, the side blocks 178 and the center block 180 have shorter heights than the height of the corner blocks 176.

The cross members, including the top side outer cross members 22, the top side cruciform cross members 24, the top side ladder cross members 26, the bottom side outer cross members 28, and the bottom side cruciform cross members 30, can have the same general structure as the cross members of the pallet 10 of FIGS. 1-8.

As can be seen in FIGS. 24 and 25, the top side outer cross members 22 extend over the side blocks 178 and the top side cruciform members 24 extend over the center block 180. Similarly, the bottom side outer cross members 28 extend under the side blocks 178 and the bottom side cruciform members 30 extend under the center block 180. In other words, the side blocks 178 and the center block 180 are covered by the cross members. The pallet 174 can have increased strength, particularly at the portions of the side blocks 178 and the center block 180.

Pallets having other structural arrangement of blocks and cross members are also contemplated by the present invention.

Figure 26:
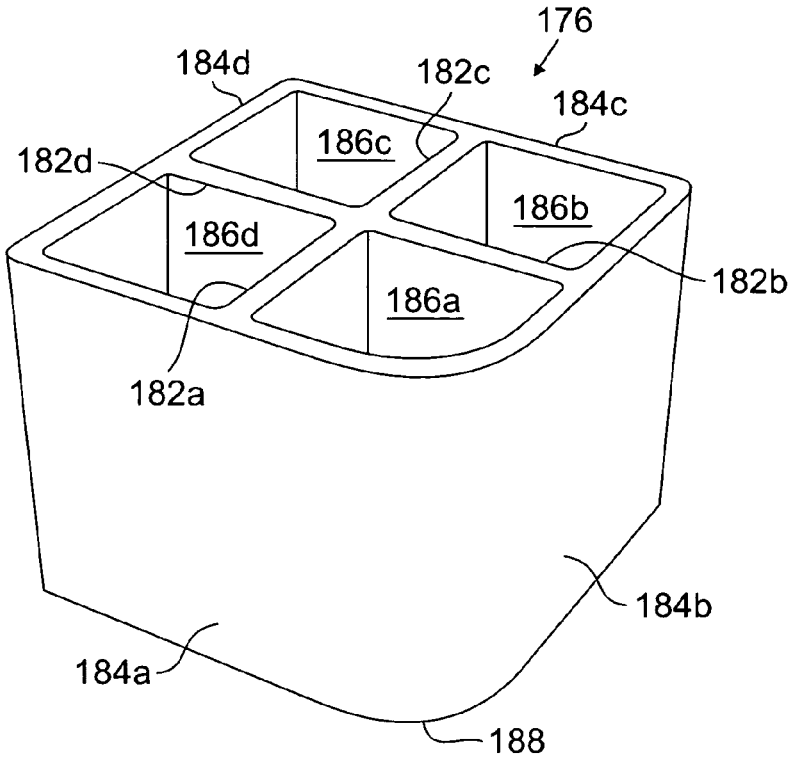
FIG. 26 shows a perspective view of a corner block of the pallet of FIG. 24.

FIG. 26 shows a perspective view of the corner block 176 of the pallet of FIGS. 24 and 25. The corner block 176 has internal walls 182*a-d* which along with the external walls 184*a-d* form internal crush cells 186*a-d* which can provide one or more crush zones. The outer corner 188 of the corner block 176 is rounded and tends to deform inward during impact. The crush cell 186*a* at the outer rounded corner 188 absorbs energy and reduces impact damage to the pallet 174.

Figure 27:
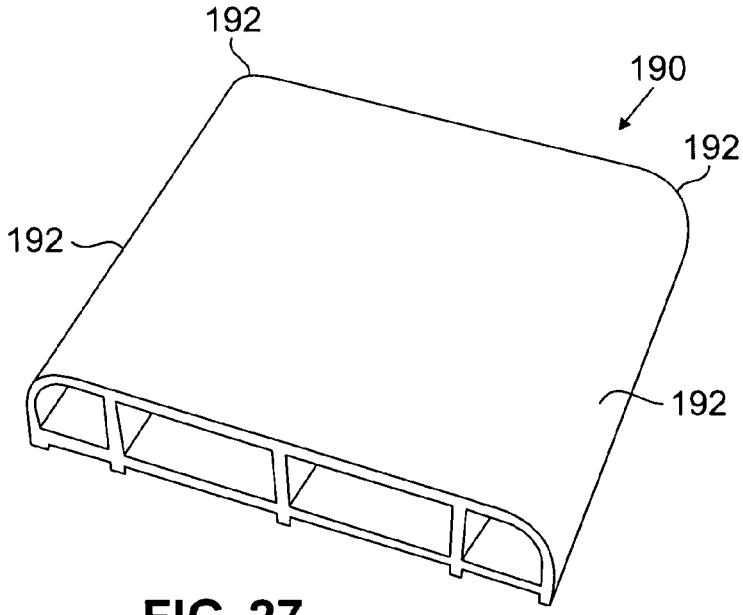
FIG. 27 shows a perspective view of another bottom cross member according to the present invention.

FIG. 27 shows another bottom side cross member 190 according to the present invention. The bottom side cross member 190 is similar to the bottom side cross member 28 of FIGS. 8*a, b* except the outer corners 192 are rounded rather than slanted. The rounded corners 192 easily guides fork tines to ride on top of the bottom side cross member 190 when the fork tines are being inserted in the pallet. This reduces impacts and damage by the fork tines.

Figure 28:
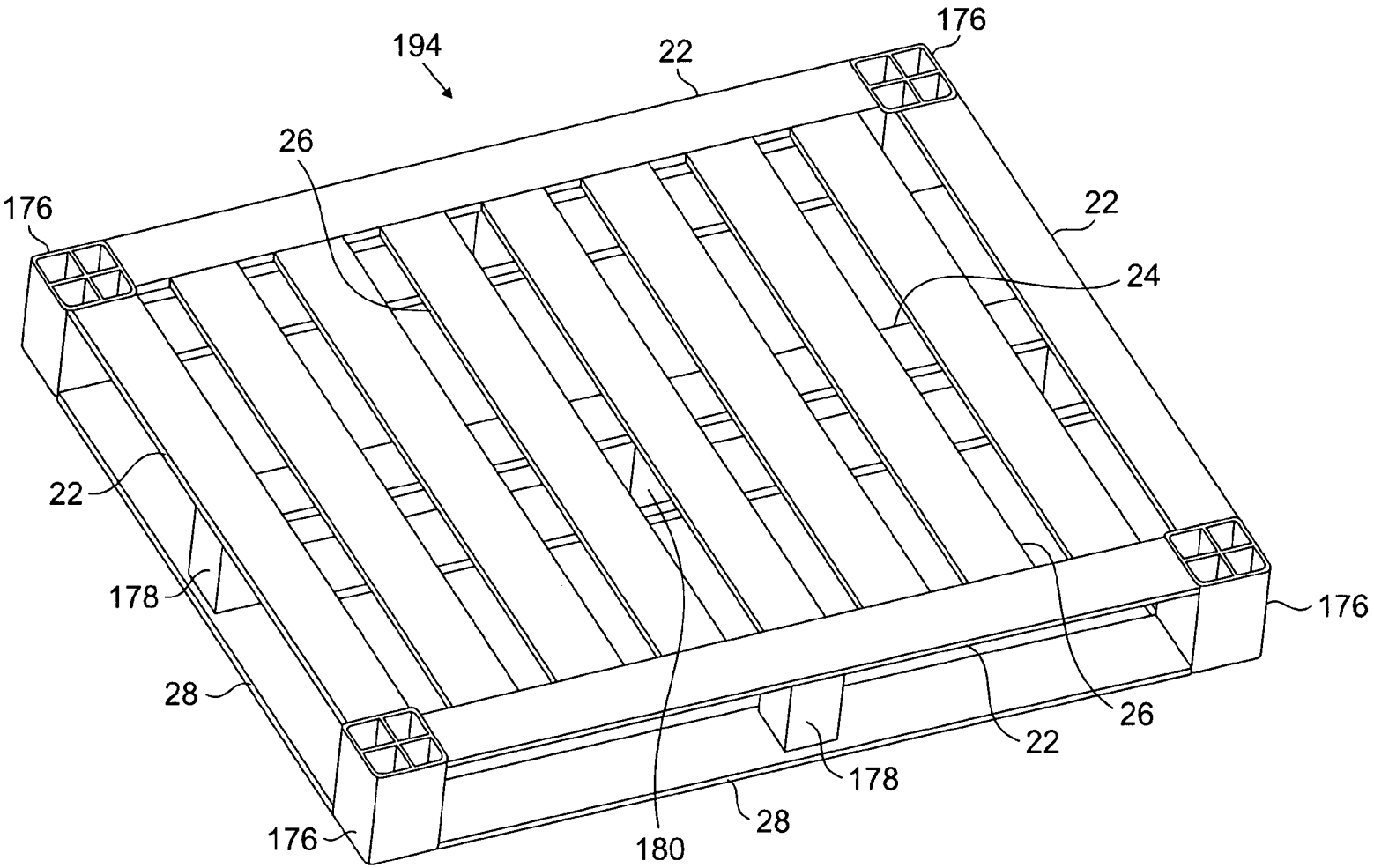
FIG. 28 shows a top perspective view of another pallet according to the present invention.
Figure 29:
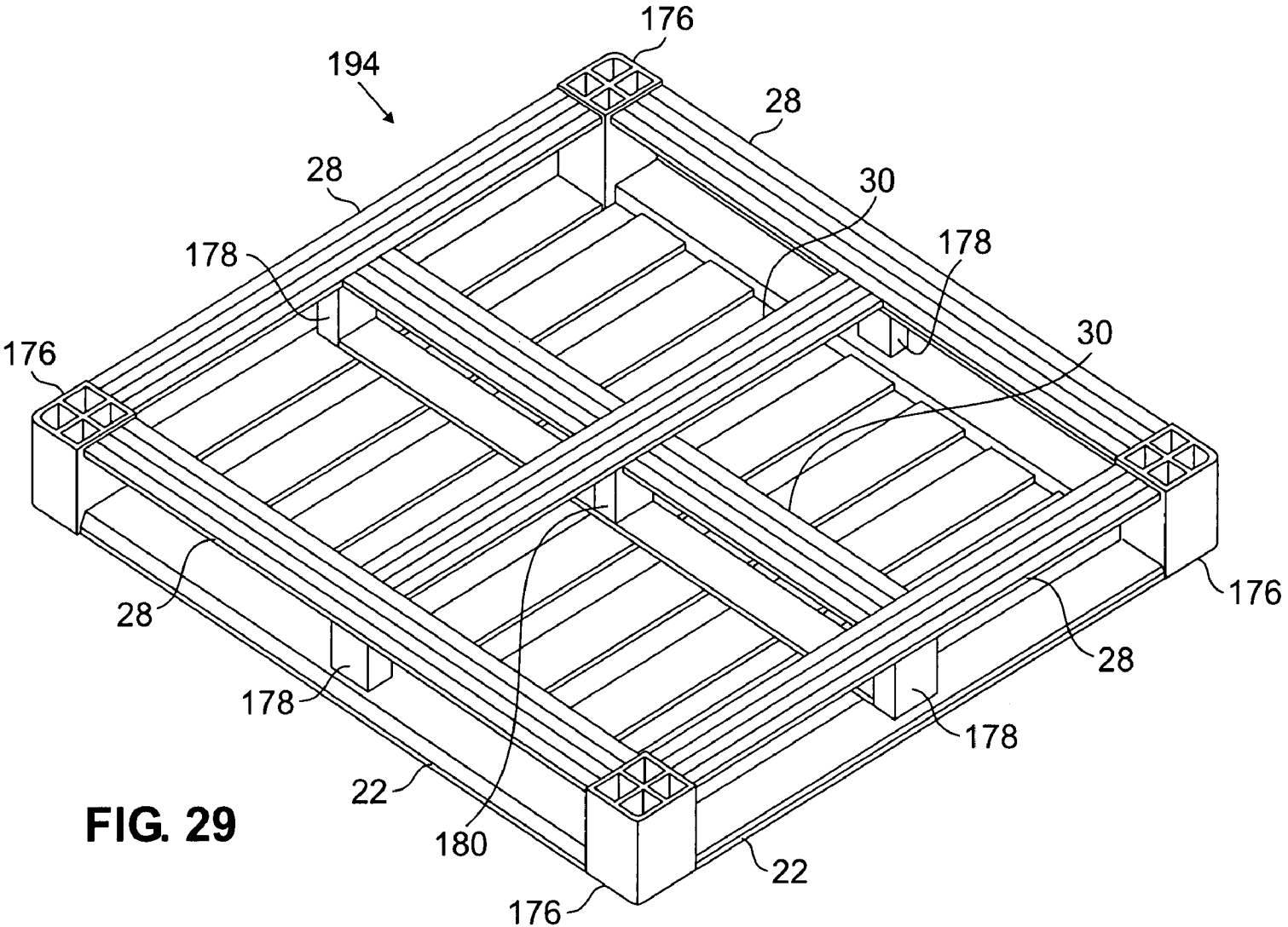
FIG. 29 shows a bottom perspective view of the pallet of FIG. 28.

FIGS. 28 and 29 show a pallet 194 which has various features similar to the features of the pallet 174 shown in FIGS. 24 and 25. The pallet 174 has corner blocks 176, side blocks 178 and a center block 180 as in the pallet 174, although the block heights may be further changed to accommodate the structure of the pallet 194.

The cross members, including the top side outer cross members 22, the top side cross member 24, the top side ladder cross members 26, the bottom side outer cross members 28, and the bottom side cruciform cross members 30, can have the same general structure as the cross members of the pallet 174 of FIGS. 24 and 25.

As can be seen in FIGS. 28 and 29, the top side ladder cross members 26 extend across the pallet 194 from a top side outer cross member 22 to an opposite top side outer cross member 22. The ladder members 26 are positioned on top of the cross member 24. The pallet 194 can have increased strength and a reduced amount of joints, such as weld joints, between pallet components.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention claimed is:

1. A metallic pallet of the type for supporting objects for storage and transport, the pallet comprising:
- a generally planar top side defining at least three corners;
- a generally planar bottom side defining at least three corners;
- at least one block extending between the top and bottom sides for holding the top and bottom sides in generally parallel spaced and aligned relation to one another such that each corner of the top side is vertically aligned over a corner of the bottom side in corresponding pairs;
- at least three generally hollow corner blocks, each corner block extending between a respective aligned pair of the corners of the top and bottom sides;
- the corner blocks each interrupting the generally planar top and bottom sides such that the top and bottom sides do not overlie and do not extend beyond the outer exposed surfaces of the corner blocks, whereby corner impacts to the pallet during a crush mode is substantially absorbed entirely by deformation of the hollow corner blocks without distorting the planar configurations of the top and bottom sides.

2. The pallet of claim 1, wherein at least one hollow corner block has at least one crush cell at an outer corner portion thereof.

3. The pallet of claim 2, wherein the crush cell comprises an internal wall structure of the hollow corner block.

4. The pallet of claim 2, wherein the crush cell has a generally cylindrical shape.

5. The pallet of claim 2, wherein the crush cell is a first crush cell arranged at the outer corner of the hollow corner block, and further including a second crush cell arranged sequentially from the first crush cell toward an inner corner portion of at least one hollow corner block.

6. The pallet of claim 5, further comprising a third crush cell arranged sequentially from the second crush cell toward the inner corner portion of the at least one hollow corner block.

7. The pallet of claim 1, wherein the hollow corner blocks comprise a wall having a groove which changes shape during a crush mode of the corner block.

8. The pallet of claim 1, wherein a cross member at an outer perimeter of the pallet has different portions, each portion having a different wall thickness.

9. The pallet of claim 1, wherein the top side includes a plurality of cross members extending between and interconnecting the at least one block and the corner blocks, and wherein the corner blocks and the cross members are constructed of extruded aluminum.

10. The pallet of claim 1, wherein the top side includes a plurality of cross members extending between and interconnecting the at least one block and the corner blocks, and wherein at least one corner block includes a torque tower portion disposed at the point of connection to an adjacent cross member.

11. The pallet of claim 10, wherein the torque tower portion comprises a notch in an outer wall of the hollow block and an internal wall structure connected to the outer wall by the notch.

12. The pallet of claim 1, wherein the top side includes a plurality of cross members extending between and interconnecting the at least one block and the corner blocks, and wherein the bottom side includes a plurality of cross members extending between and interconnecting the at least one block and the corner blocks.

13. A metallic pallet of the type for supporting objects for storage and transport, the pallet comprising:

a generally planar top side having a substantially rectangular configuration defining four corners;

a generally planar bottom side having a substantially rectangular configuration defining four corners;

five blocks spaced apart from one another, each block extending between the top and bottom sides for holding the top and bottom sides in generally parallel spaced and aligned relation to one another such that the corners of the top side are vertically aligned over the corners of the bottom side in corresponding pairs;

four generally hollow corner blocks, each of the corner blocks extending between a respective aligned pair of the corners of the top and bottom sides;

the top side including a plurality of cross members extending between and interconnecting the blocks and the corner blocks; the top side further including a plurality of ladder members extending between and interconnecting the respective cross members;

the bottom side including a plurality of cross members extending between and interconnecting the blocks and the corner blocks;

the corner blocks each interrupting the generally planar top and bottom sides such that the top and bottom sides after do not overlie and do not extend beyond the outer exposed surfaces of the corner blocks, whereby corner impacts to the pallet during a crush mode is substantially absorbed entirely by deformation of the hollow corner blocks without distorting the planar configurations of the top and bottom sides.

* * * * *